US007770518B2

(12) United States Patent
Barinaga et al.

(10) Patent No.: US 7,770,518 B2
(45) Date of Patent: Aug. 10, 2010

(54) WEB APPARATUS FOR CLEANING ARCUATE PRINTHEAD ARRANGEMENT

(75) Inventors: John Barinaga, Portland, OR (US); Tanya V. Burmeister, Vancouver, WA (US); Stephanie L. Seaman, Portland, OR (US); Alan Shibata, Camas, WA (US); Russell P. Yearout, Brush Prairie, WA (US); Antonio Gomez, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 630 days.

(21) Appl. No.: 11/081,161

(22) Filed: Mar. 16, 2005

(65) Prior Publication Data

US 2006/0209152 A1 Sep. 21, 2006

(51) Int. Cl.
*B41F 35/00* (2006.01)
*B41J 2/165* (2006.01)

(52) U.S. Cl. ..... 101/425; 347/22; 347/33

(58) Field of Classification Search ..... None
See application file for complete search history.

(56) References Cited

U.S. PATENT DOCUMENTS

| | | | | |
|---|---|---|---|---|
| 2,886,841 | A * | 5/1959 | Wilcox | 15/160 |
| 3,477,083 | A | 11/1969 | Park | |
| 3,745,243 | A * | 7/1973 | Seitz | 358/296 |
| 4,071,296 | A | 1/1978 | Ermel et al. | |
| 4,223,322 | A | 9/1980 | Van Raamsdonk | |
| 4,291,353 | A | 9/1981 | Fletcher et al. | |
| 4,357,615 | A | 11/1982 | Yoshiharu et al. | |
| 4,369,456 | A | 1/1983 | Cruz-Uribe et al. | |
| 4,408,241 | A | 10/1983 | Ogawa | |
| 4,437,105 | A | 3/1984 | Mrazek et al. | |
| 4,450,456 | A | 5/1984 | Jekel et al. | |
| 4,528,996 | A | 7/1985 | Jones | |
| 4,538,160 | A * | 8/1985 | Uchiyama | 347/101 |
| 4,571,601 | A * | 2/1986 | Teshima | 347/33 |
| 4,611,361 | A | 9/1986 | Shinkai | |
| 4,628,388 | A | 12/1986 | Kawabe | |
| 4,631,616 | A | 12/1986 | Zago et al. | |
| 4,686,132 | A | 8/1987 | Sumii et al. | |
| 4,829,318 | A * | 5/1989 | Racicot et al. | 347/33 |
| 4,894,743 | A | 1/1990 | Clausen | |
| 4,933,015 | A | 6/1990 | White | |
| 4,953,252 | A * | 9/1990 | Akisawa | 15/308 |
| 5,075,919 | A | 12/1991 | Rogers et al. | |
| 5,117,754 | A * | 6/1992 | Nozaka et al. | 101/425 |
| 5,153,964 | A | 10/1992 | Gelardi et al. | |
| 5,181,292 | A | 1/1993 | Aghachi | |
| 5,196,864 | A * | 3/1993 | Caine | 347/171 |
| 5,223,329 | A | 6/1993 | Amann | |
| 5,227,844 | A | 7/1993 | Bhattacharjee et al. | |
| 5,300,958 | A | 4/1994 | Burke et al. | |

(Continued)

FOREIGN PATENT DOCUMENTS

GB 2198693 A 6/1988

(Continued)

OTHER PUBLICATIONS

IBM Technical Disclosure Bulletin, vol. 30, No. 8, Jan. 1988, New York, USA, pp. 362-363, "Disposable Cartridge Fluid Collection System."

*Primary Examiner*—Jill E Culler

(57) ABSTRACT

Various embodiments of a web are disclosed.

39 Claims, 12 Drawing Sheets

U.S. PATENT DOCUMENTS 5,383,733 A * 1/1995 Zinsmeyer et al. ..... 400/208
5,432,539 A 7/1995 Anderson
5,500,659 A 3/1996 Curran, Jr. et al.
5,517,221 A 5/1996 Nguyen
5,517,222 A 5/1996 Sugiyama et al.
5,589,861 A 12/1996 Shibata
5,589,865 A 12/1996 Beeson
5,635,965 A 6/1997 Purwins et al.
5,706,038 A 1/1998 Jackson et al.
5,735,212 A * 4/1998 Oyaizu ..... 101/423
5,754,197 A 5/1998 Shibata
5,757,387 A 5/1998 Manduley
5,769,548 A * 6/1998 Thompson et al. ..... 400/208
5,793,390 A 8/1998 Claflin et al.
5,871,292 A 2/1999 Johnson et al.
5,905,514 A 5/1999 Rhoads et al.
5,907,335 A 5/1999 Johnson et al.
5,914,734 A 6/1999 Rotering et al.
5,963,228 A 10/1999 Purwins
5,966,145 A 10/1999 Miura et al.
5,969,731 A 10/1999 Michael et al.
6,017,110 A 1/2000 Jackson
6,042,228 A * 3/2000 Yamada et al. ..... 347/104
6,045,211 A 4/2000 Tokuda
6,149,262 A * 11/2000 Shiida et al. ..... 347/37
6,154,232 A * 11/2000 Hickman et al. ..... 347/40
6,170,946 B1 1/2001 Yasui et al.
6,183,060 B1 2/2001 Tokuda
6,196,653 B1 3/2001 Igarashi et al.
6,206,498 B1 3/2001 Kondo et al.
6,217,145 B1 4/2001 Ito et al.
6,224,186 B1 5/2001 Johnson et al.
6,312,094 B1 11/2001 Ito et al.
6,336,699 B1 1/2002 Sarkissian et al.
6,350,012 B1 2/2002 Sarkissian et al.
6,378,975 B1 4/2002 Elgee et al.
6,382,767 B1 5/2002 Greive
6,461,064 B1 10/2002 Leonard et al.
6,588,954 B2 * 7/2003 Verhoest et al. ..... 400/635
6,598,531 B2 * 7/2003 Nedblake et al. ..... 101/490
6,663,215 B2 12/2003 Klausbruckner et al.
6,692,100 B2 2/2004 Steinfield et al.
6,695,429 B2 2/2004 Barinaga
6,733,106 B1 * 5/2004 Leemhuis ..... 347/22
6,742,864 B2 6/2004 Therien et al.
6,834,930 B2 12/2004 Steinfield et al.
6,869,161 B2 3/2005 Wouters et al.
6,913,341 B2 * 7/2005 Barinaga et al. ..... 347/29
2002/0171705 A1 11/2002 Rhoads et al.
2003/0197754 A1 10/2003 Nakamura
2004/0022568 A1 * 2/2004 Menendez et al. ..... 400/76
2004/0080563 A1 4/2004 Leemhuis
2004/0161278 A1 * 8/2004 Harada ..... 400/621
2004/0218002 A1 11/2004 Nakamura
2004/0223029 A1 11/2004 Nishino
2005/0156995 A1 7/2005 Nishino
2005/0162461 A1 7/2005 Fujimori et al.
2005/0185016 A1 8/2005 Mori et al.

FOREIGN PATENT DOCUMENTS

JP 62270367 11/1987
JP 63260451 10/1988
JP 5064895 3/1993
JP 05185599 7/1993

* cited by examiner

FIG. 1
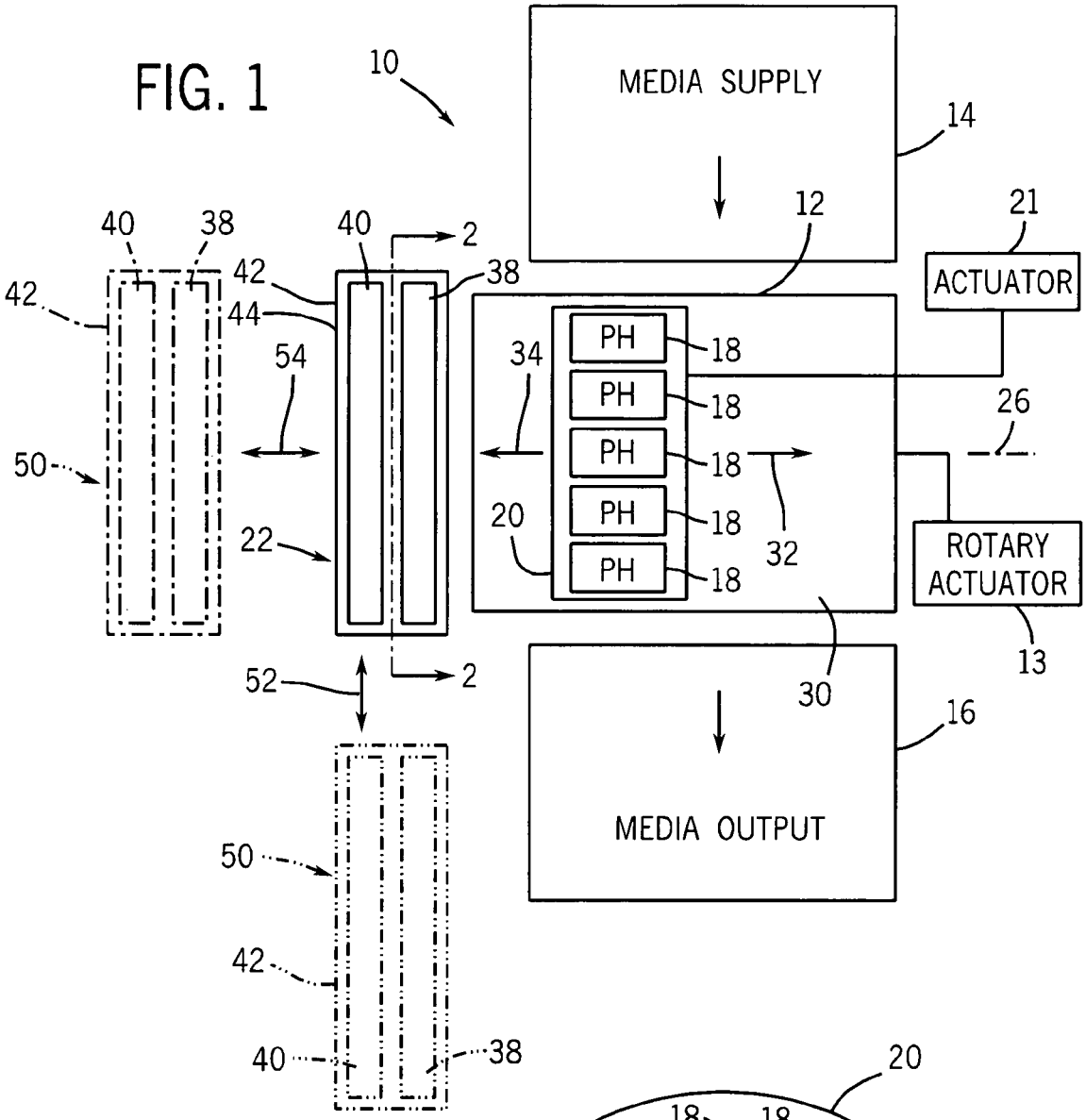
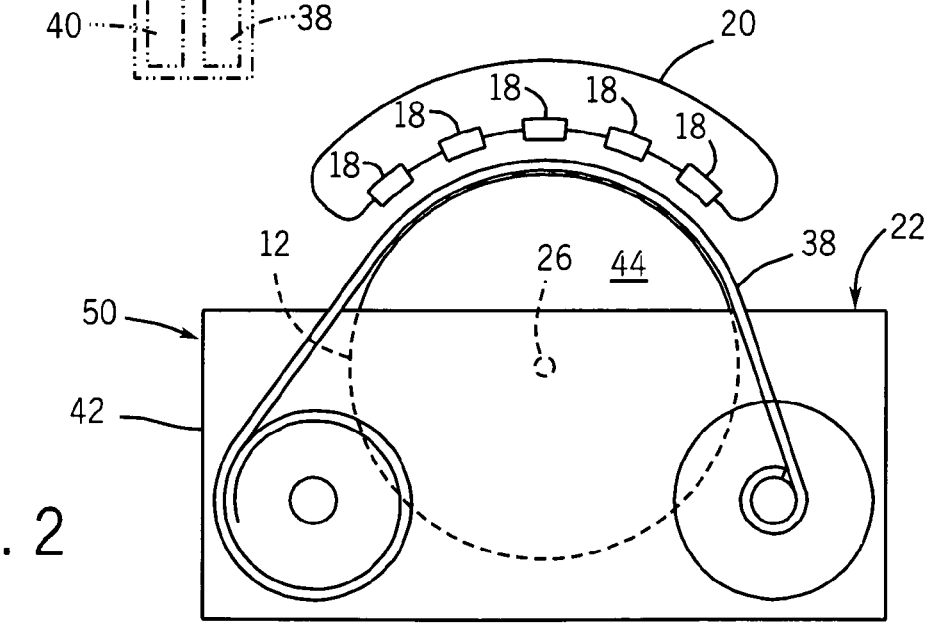
FIG. 2

WEB APPARATUS FOR CLEANING ARCUATE PRINTHEAD ARRANGEMENT

BACKGROUND

Printheads are used to deposit ink upon media. During use, printheads are sometimes serviced with such operations as spitting and wiping. Those components of printers used for servicing the printheads are sometimes inadequate.

BRIEF DESCRIPTION OF THE DRAWINGS

FIG. 1 is a schematic illustration of a printing system according to one exemplary embodiment.

FIG. 2 is a sectional view of the printing system of FIG. 1 according to one exemplary embodiment.

DETAILED DESCRIPTION OF THE EXAMPLE EMBODIMENTS

Figure 3:
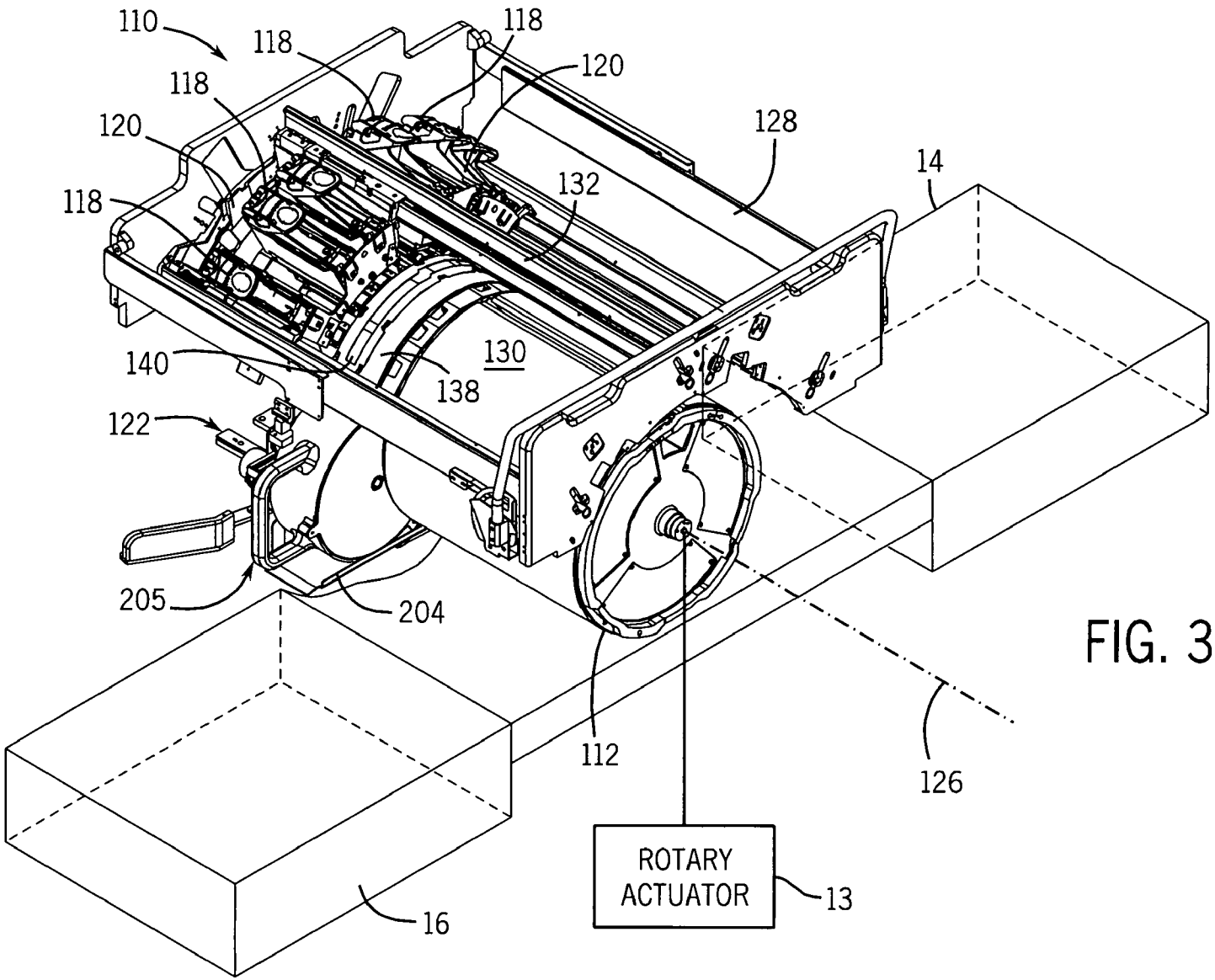
FIG. 3 is a perspective view of another embodiment of the printing system of FIG. 1 with portions schematically shown according to one exemplary embodiment.

FIGS. 1 and 2 schematically illustrate printing system 10 according to one exemplary embodiment. Printing system 10 generally includes drum 12, rotary actuator 13, media supply 14, media output 16, printheads 18, carriage 20, actuator 21 and service station 22. Drum 12 generally comprises an elongated cylinder configured to be rotatably driven about axis 26 by rotary actuator 13 while transporting media, such as paper, about axis 26 relative to printheads 18. Rotary actuator 13 comprises a source of torque, such as a motor, operably coupled to drum 12 by a transmission (not shown).

Media supply 14, schematically shown, comprises a mechanism configured to supply media to drum 12. In one embodiment, media supply 14 comprises a mechanism configured to pick an individual sheet of media from a stack of media and to supply the individual sheet to drum 12 such that the sheet is wrapped at least partially about drum 12. Media output 16, schematically shown, comprises a mechanism to withdraw printed upon media from drum 12 and to transport withdrawn media to and contain withdrawn media within an output tray, bin or the like.

Printheads 18 comprise printheads configured to dispense imaging material, such as ink, upon the medium held by drum 12. In one embodiment, printheads 18 comprise piezo electric printheads. In another embodiment, printheads 18 comprise thermal inkjet printheads. As shown by FIG. 2, printheads 18 are arranged in an arc about axis 26. As a result, printheads 18 are configured to print across a larger area of the media supported by drum 12. In the particular embodiment, drum 12 has an outer surface 30 also arranged in an arc about axis 26. Printheads 18 are arranged in an arc substantially identical to the arc in which surface 30 extends.

Carriage 20 comprises one or more structures configured to support printheads 18 in the arcuate arrangement. In addition, carriage 20 is configured to movably support printheads 18 along axis 26. Actuator 21 comprises a linear actuator configured to move carriage 20 and printheads 18 in the directions indicated by arrows 32, 34 so as to selectively position printheads 18 opposite to the media held by drum 12 or opposite to service station 22. In one embodiment, actuator 21 may comprise a motor configured to drive a toothed pulley in engagement with a toothed belt coupled to carriage 20. In another embodiment, actuator 21 may comprise other forms of a linear actuator using rack and pinion arrangements, hydraulic, pneumatic or electrical means. Although system 10 is illustrated as including five printheads supported by a single carriage 20, system 10 may alternatively include a greater or fewer number of such printheads 18 supported by one or more carriages 20.

Service station 22 comprises a station located on an axial end of drum 12 such that carriage 20 may position printheads 18 opposite, or adjacent, to station 22. Station 22 includes one or more components configured to perform servicing operations upon one or more of the printheads 18. As shown by FIG. 1, service station 22 includes two webs 38, 40 of material for performing servicing operations upon printheads 18. In one embodiment, web 38 is configured to interact with printheads 18 by receiving printing material or ink discharged from printheads 18. For example, in one embodiment, printheads 18 include multiple nozzles. Web 38 facilitates spitting of ink from the nozzles to clear such nozzles. In one embodiment, web 38 comprises a web of fluid absorbent material. In one embodiment, web 38 comprises a fabric material.

Web 40 comprises an elongate band of material configured to perform a distinct servicing operation upon printheads 18. In the embodiment illustrated, web 40 comprises a web of material configured to physically contact the surfaces of printheads 18 so as to wipe printheads 18. In the particular example illustrated, web 40 is configured to contact the surfaces of printheads 18 as carriage 20 moves printheads 18 along axis 26 relative to web 40 to wipe printheads 18. In other embodiments, web 40 may additionally be configured to be moved relative to printheads 18 to perform such wiping operations. According to one embodiment, web 40 is formed from a fabric material such as Evolon 100 commercially available from Freudenberg Group of Germany.

As shown by FIG. 2, in the particular example shown, service station 22 further includes a housing 42 and a track 44. Housing 42 comprises one or more walls, panels, structures and the like configured to support track 44 and webs 38, 40 relative to drum 12. As shown by FIG. 1, housing 42 supports track 44 and webs 38, 40 as a single individual unit or cartridge 50 that is configured to be removed from drum 12. In one embodiment, cartridge 50 is configured to be inserted adjacent to or removed from drum 12 by movement substantially perpendicular to axis 26 as indicated by arrows 52. In another embodiment, cartridge 50 is configured to be inserted adjacent to or removed from drum 12 in a direction substantially parallel to axis 26 as indicated by arrow 54. The removability of cartridge 50 facilitates replacement, repair, refurbishment, or refilling of cartridge 50. For example, when one or both of webs 38, 40 becomes sufficiently saturated with printing material or ink from printheads 18, cartridge 50 may be removed and either replaced with an entirely new cartridge or be refilled with another one of webs 38 and/or 40. Alternatively, if cartridge 50 has become damaged, cartridge 50 may be replaced. As a result, the useful life of printing system 10 is not limited by the useful life of web 38 or web 40. In other embodiments, housing 42 may alternatively be fixed relative to drum 12 so as to not be removable and reinsertable as a cartridge 50.

As shown by FIG. 2, track 44, schematically shown, comprises one or more structures configured to support webs 38 and 40 (shown in FIG. 1) in an arc about axis 26. In the particular example shown, track 44 is configured to support webs 38 and 40 about an arc substantially similar to the arc along which printheads 18 are arranged. In one embodiment, track 44 comprises an elongate arcuate panel or surface underlying webs 38, 40. In yet another embodiment, track 44 comprises multiple individual surfaces that are spaced from one another in an arc. For example, in one embodiment, track 44 may be formed from multiple rollers extending in the arc. Because track 44 supports webs 38 and 40 in an arc, webs 38 and 40 may be used to simultaneously service multiple printheads 18.

FIGS. 3-20 illustrate a printing system 110, another embodiment of printing system 10 shown in FIGS. 1 and 2. As shown by FIG. 3, printing system 110 generally includes drum 112, media supply 14, media output 16, printheads 118, carriages 120 and service station 122. Drum 112 comprises an elongate cylinder configured to be rotatably driven about axis 126 by rotary actuator 13 described above with respect to system 10. Drum 112 includes an outer cylindrical surface 130 which extends in an arc and which supports media while the media is rotated about axis 126. Media is supplied to drum 112 by media supply 14 (schematically shown) and is withdrawn from drum 12 by media output 16 (schematically shown and described with respect to system 10).

Printheads 118 comprise printheads configured to dispense imaging material upon medium held by drum 112. In the particular embodiment illustrated, printheads 118 comprise thermal inkjet printheads. Printheads 118 are arranged in an arc about axis 126. As a result, printheads 118 may print across a larger area of the media supported by drum 112. In the particular embodiment illustrated, surface 130 of drum 112 has a radius of approximately six inches. Printheads 118 are correspondingly arranged in an arc having a radius of about 6.04 inches. In other embodiments, different dimensions may be alternatively employed.

Carriages 120 comprise structures configured to support printheads 118 in the arcuate arrangement. In the particular example shown, system 110 includes six circumferentially and arcuately arranged printheads supported by two circumferentially arranged carriages 120. In other embodiments, a greater or fewer number of printheads 118 as well as a greater or fewer number of carriages 120 may be utilized. Carriages 120 are movably supported relative to drum 112 by frame 128 which comprises a framework of one or more structures supported relative to drum 112. In the example shown, frame 128 includes an elongate rail 132 and a pair of opposite rods (not shown) along which carriages 120 are moved axially along drum 112 by an actuator 21 (shown and described with respect to FIG. 1). In other embodiments, carriage 120 may be driven along axis 126 between surface 130 of drum 112 and service station 122 by other mechanisms.

Service station 122 comprises a station located on an axial end of drum 112 such that carriages 120 may position printheads 118 opposite to station 122. As shown by FIG. 3, service station 122 generally includes webs 138, 140 of material for performing servicing operations upon printheads 118. Web 138 is configured to interact with printheads 118 by receiving printing material ink discharged from printheads 118. Web 138 facilitates spitting of ink from nozzles of printheads 118. In the particular embodiment illustrated, web 138 comprises a web of fluid absorbent material. In one embodiment, web 138 comprises a fabric material such as Evolon 100 supplied by Freudenberg Group. In other embodiments, web 138 may comprise other materials for performing servicing operations upon printheads 118.

Web 140 comprises an elongated band of material configured to form a distinct servicing operation upon printheads 118. In the embodiment shown, web 140 comprises a web of material configured to physically contact the surfaces of printheads 118 so as to wipe printheads 118. In the example shown, web 140 is configured to contact the surfaces of printheads 118 as carriages 120 to carry printheads 118 along axis 26 relative to web 140 to wipe printheads 118. According to one embodiment, web 140 is formed from a fabric material such as Evolon 100, supplied by Freudenberg Group. In other embodiments, web 140 may be composed of one or more other materials.

Figure 4:
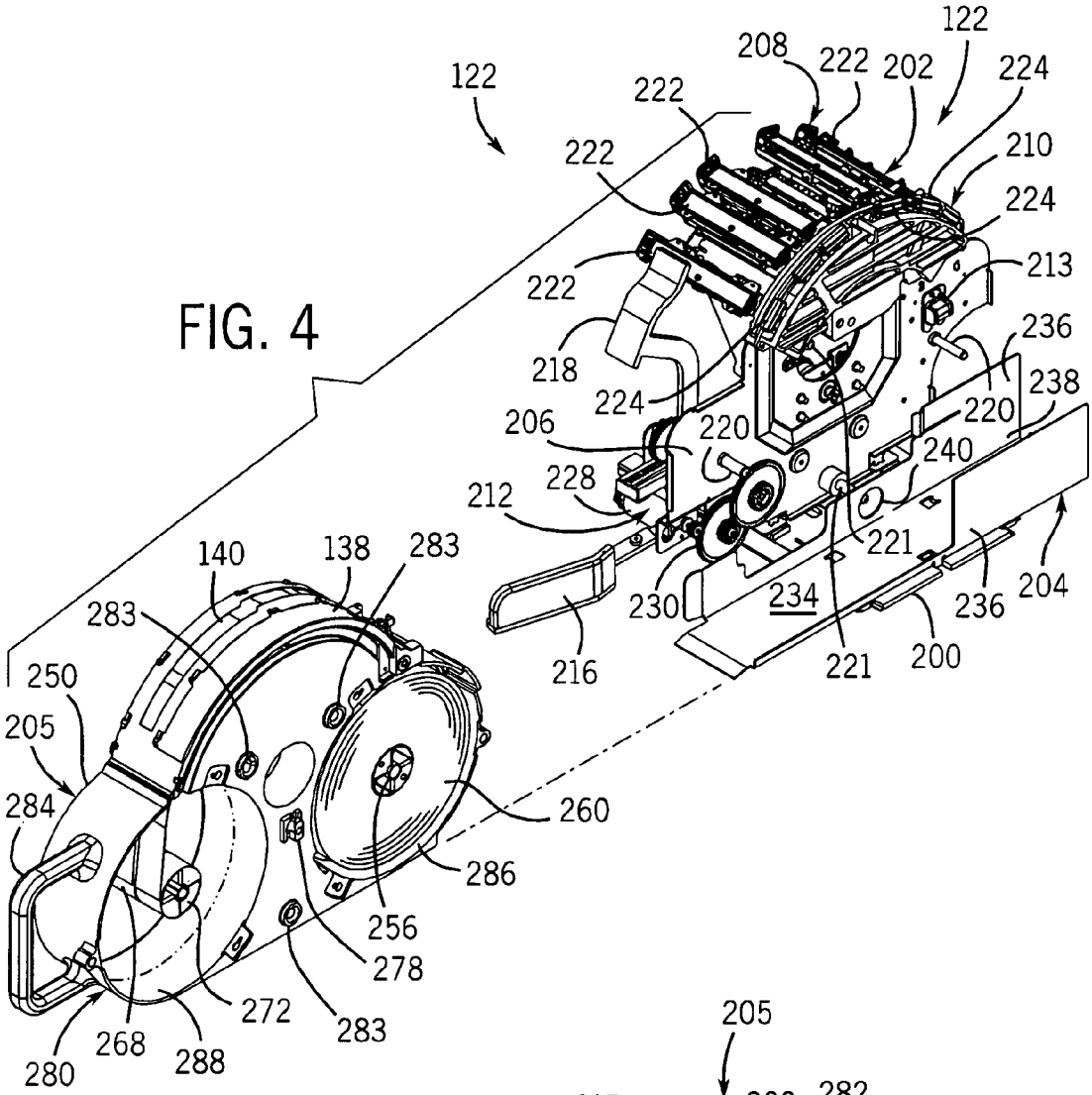
FIG. 4 is top perspective view of a service station of the printing system of FIG. 3 illustrating removal of a cartridge from a chassis according to one exemplary embodiment.

FIG. 4 illustrates service station 122 in greater detail. As shown by FIG. 4, service station 122 generally includes base 200, chassis 202, guide 204 and cartridge 205 providing webs 138 and 140. Base 200 generally comprises a foundation of service station 122 and is generally fixed relative to frame 128 (shown in FIG. 3). Although illustrated as being formed by multiple plates or bars fastened, welded or otherwise coupled together, base 200 may be formed from other structures and may have other configurations.

Chassis 202 supports and positions cartridge 205 relative to drum 112 (shown in FIG. 3), drives webs 138 and 140 and performs additional servicing operations upon printheads 118 (shown in FIG. 3). Chassis 202 generally includes frame 206, capping system 208, torque source 212, sensor 213, retraction system 216 and latching system 218. Frame 206 comprises a structure configured to support capping system 208, wiper actuation system 210, torque source 212, retraction system 216 and latching system 218. As will be described in detail hereafter, frame 206 slides relative to base 200 with assistance from retraction system 216 to move capping system 208 towards drum 112, to move actuation system 210 to a position opposite web 140 and to move torque source 212 into operable engagement with cartridge 205.

As shown by FIG. 4, frame 206 includes spindles 220 and datum pins 221. Spindles 220 project towards guide 204 and are configured to interact with cartridge 205 to rotatably support spools 252, 256 and spools 266, 272 as well as windings 254 and 260. Datum pins 221 project towards guide 204 and are configured to be inserted into corresponding bores or openings in cartridge 205 to ensure proper alignment of cartridge 205 with chassis 202. Although shown as substantially comprising a generally flat metal plate to which components of chassis 202 are mounted, frame 206 may alternatively have other shapes and configurations and may be integrally formed as part of a single unitary body with some of the other components.

Capping system 208 is coupled to frame 206 and includes fixed arcuately arranged with supported capping modules 222. Capping modules 222 are configured to selectively cap or decap printheads 118 (shown in FIG. 3). Capping modules 222 are upper surfaces that interact with printheads 118 that are supported in an arc substantially the same as the arc in which printheads 118 are supported by carriages 120. In other embodiments, capping modules 222 may have other configurations or may be omitted.

Wiper actuation system 210 comprises a mechanism configured to move web 140 into or out of engagement with printheads 118 when printheads 118 are positioned over web 140. In the particular embodiment illustrated, actuation system 210 includes six lifters 224 arranged in an arc about axis 126 (shown in FIG. 3). Lifters 224 are configured to be moved between a raised position in which lifters 224 engage an underside of web 140 to urge web 140 into contact with printheads 118 (shown in FIG. 3) and a lowered position allowing web 140 to be separated from printheads 118. Lifters 224 are arranged in an arc substantially similar to the arc along which printheads 118 are supported by carriages 120. More details regarding wiper actuation system 210 and lifters 224 may be found in co-pending U.S. patent application Ser. No. 11/082,093, filed on the same date herewith by Barjnaga et al. and entitled WIPER, the full disclosure of which is hereby incorporated by reference. In other embodiments, actuation system 210 may have other configurations or may be omitted.

Torque source 212 comprises a mechanism configured to deliver torque to cartridge 205 so as to move webs 138 and 140. Torque source 212 is supported by frame 206 and includes motor 228 and transmission 230. Motor 228 comprises an electric motor providing power that is transmitted by transmission 230. Transmission 230 comprises a series of gears configured to appropriately adjust the speed and the torque provided by motor 228 and to deliver such power to cartridge 205. In other embodiments, torque source 212 may comprise power sources other than an electric motor and may include other forms of transmission 230 such as belts, pulleys, chains, sprockets and the like.

Sensor 213 is coupled to frame 206 so as to sense and detect the remaining windings of material contained within cartridge 205. In the particular example shown, sensor 213 is configured to cooperate with a window 302 (shown in FIG. 5) provided in cartridge 205 to detect expended and remaining amounts of servicing windings 254, 260 (shown in FIG. 6) that have been used by service station 122. In the particular example shown, sensor 213 comprises an optical sensor which emits light through window 302 (shown in FIG. 5) and determines the amount of windings left based upon reflected light. In other embodiments, sensor 213 may comprise other forms of sensors.

Retraction system 216 comprises a mechanism configured to move frame 206, capping system 208, actuation system 210 and torque source 212 towards and away from drum 112 (shown in FIG. 3) and cartridge 205 received within guide 204. In particular, actuation of retraction system 216 engages or disengages torque source 212 and spindles 220 with respect to cartridge 205. In the particular example illustrated, retraction system 216 additionally moves guide 204 relative to frame 206 and relative to drum 112.

Latching system 218 comprises a mechanism configured to releasably secure and retain cartridge 205 relative to chassis 202. In the particular example shown, latching system 218 additionally clamps or urges cartridge 205 and chassis 202 into engagement with one another and against datum surfaces associated with drum 112 for reliable and consistent positioning of chassis 202 and cartridge 205. In other embodiments, latching system 218 may have other configurations or may be omitted.

Guide 204 generally comprises a structure configured to facilitate appropriate positioning of cartridge 205 relative to transmission 230 of torque source 212 and relative to spindles 220 of frame 206. In the particular example shown, guide 204 is configured to receive cartridge 205. According to one exemplary embodiment, guide 204 includes a floor 234 and opposite sidewalls 236 that form a channel 238 into which cartridge 205 may be slidably received. As shown by FIG. 4, one of sidewalls 236 additionally includes an opening 240 for the passage of one of spindles 220. Although not shown, guide 204 additionally includes one or more stop surfaces which engage cartridge 205 to indicate when cartridge 205 has been fully inserted into guide 236. As will be described in greater detail hereafter, guide 204 additionally moves or slides with respect to base 200 with the assistance of retraction system 216. In other embodiments, guide 204 may be stationary with respect to base 200 or drum 112 (shown in FIG. 3). Although shown as forming a channel 238, guide 236 may alternatively be configured to removably receive cartridge 205 from other directions or in other manners. For example, guide 204 may alternatively be configured such that cartridge 205 is lowered into or nested within guide 204.

Cartridge 205 comprises one or more structures assembled or joined as a single unit and configured to support webs 138 and 140 for interaction with printheads 118 (shown in FIG. 3). Cartridge 205 is specifically configured to be inserted into or withdrawn from guide 204, enabling cartridge 205 to be withdrawn for replacement, repair or refurbishing with one or both of webs 138, 140. As a result, the useful life of printing system 110 may not be limited based upon the useful life of web 138 or web 140.

Figure 5:
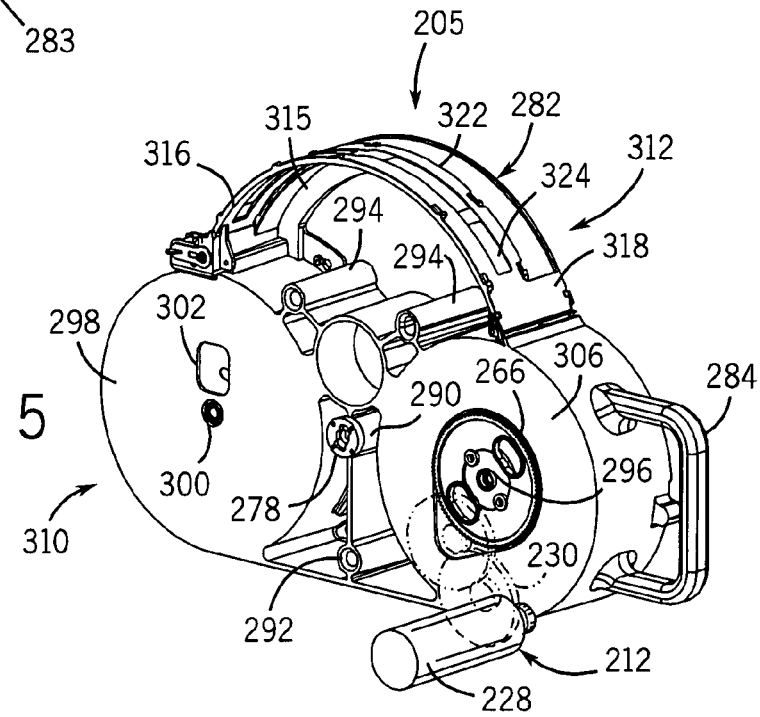
FIG. 5 is a rear perspective view of the cartridge of FIG. 4 in engagement with a torque source of the chassis of FIG. 4 according to one exemplary embodiment.
Figure 6:
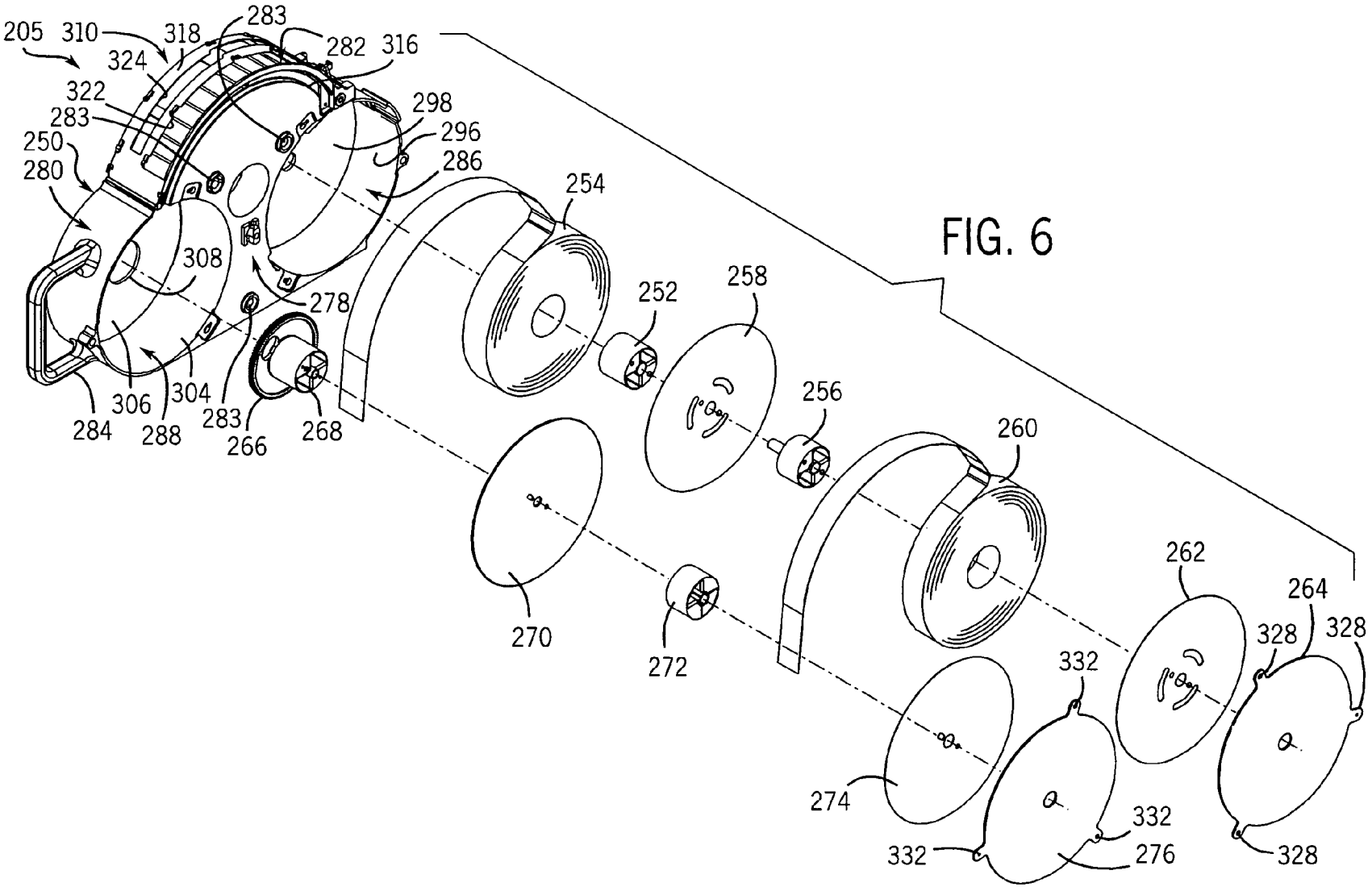
FIG. 6 is an exploded perspective view of the cartridge of FIG. 4 according to one exemplary embodiment.

FIGS. 5 and 6 further illustrate cartridge 205 in detail. As shown by FIGS. 4-6, cartridge 205 includes cartridge body 250, spool 252, winding 254, spool 256, divider 258, winding 260, covers 262, 264, torque interface 266, spool 268, divider 270, spool 272, covers 274, 276 and cartridge lock 278. Cartridge body 250 comprises a structure configured to support and guide windings 254 and 260 which provide webs 140 and 138, respectively, prior to connection with chassis 202. Once connected to chassis 202, spindles 220 support spools 252, 256 and windings 254, 260. Cartridge body 250 additionally supports those remaining elements of cartridge 205. Body 250 generally includes housing 280, track 282, drum datums 283, and handle 284. Housing 280 encloses much of the remaining components of cartridge 205. In the particular example shown, housing 280 is formed as a single integral unitary body. Housing 280 includes one or more walls or structures that form spool chamber 286, spool chamber 288, lock chamber 290 and alignment bores 292, 294. Spool chamber 286 receives spools 252, 256 and windings 254 and 260 supported by such spools. In the particular example shown, spool chamber 286 includes a generally cylindrical sidewall 296 and a sidewall 298. As shown by FIG. 5, sidewall 298 includes a spindle opening 300 which receives one of spindles 220 (shown in FIG. 4) and a viewing window 302 which is located and configured to enable an operator to view winding 254 to potentially determine an amount of winding 254 that remains.

Spool chamber 288 is similar to spool chamber 286 and includes a generally cylindrical wall 304 supported by a sidewall 306. As shown by FIG. 6, sidewall 306 includes an opening 308 through which one or both of torque interface 266 and spool 268 extend to allow torque to be transmitted across wall 306 to spool 268 and spool 272. Although spool chambers 286 and 288 are illustrated as forming generally cylindrical cavities, spool chambers 286 and 288 may alternatively form a single continuous cavity in which spools 252, 256, 268 and 272 are received.

Lock chamber 290 (shown in FIG. 5) receives lock 278. In the particular example shown, lock chamber 290 comprises a structure configured to allow lock 278 to extend from chassis side 310 to drum side 312 of cartridge 205. Although lock chamber 290 is illustrated as being generally cylindrical, lock chamber 290 may alternatively have other shapes and configurations. Lock chamber 290 is generally located at a central point or axial center line of cartridge 205 such that clamping force applied by lock 278 will be substantially centered with respect to cartridge 205.

Alignment bores 292, 294 comprise openings extending from chassis side 310 of cartridge 205. Alignment bores 292, 294 are configured to receive the corresponding projections extending from frame 206 or other portions of chassis 202 when cartridge 205 is properly aligned with chassis 202. In the particular example shown, alignment bore 292 receives a lower most spindle 220 while bores 294 receive pins or rods (not shown) extending from frame 206.

Figure 17:
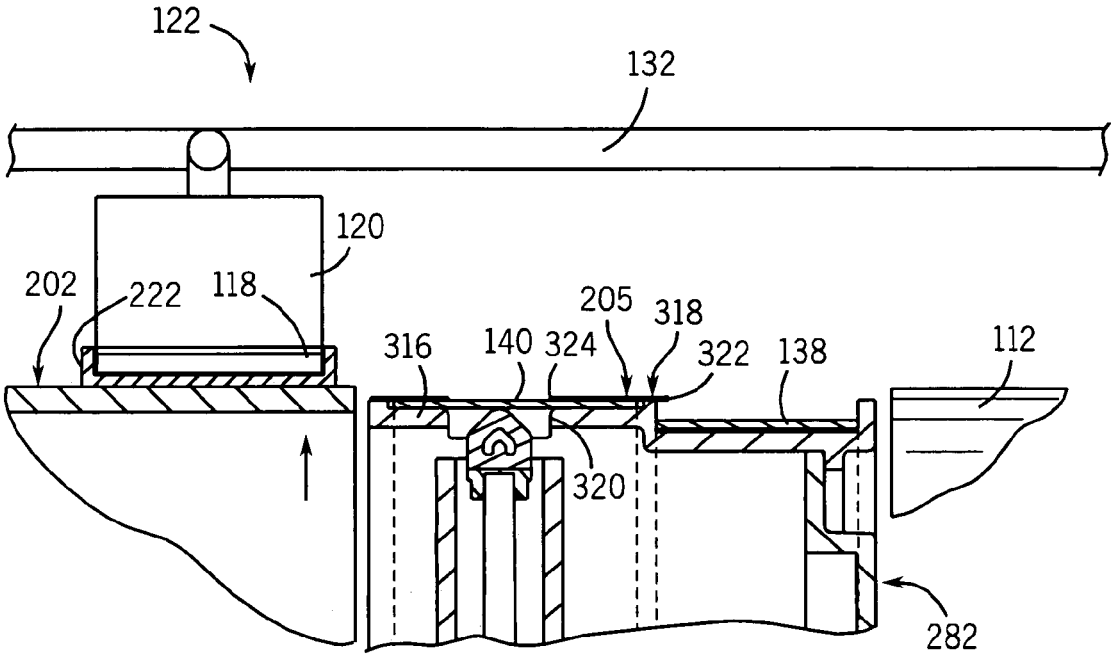
FIG. 17 is a fragmentary sectional view schematically illustrating the printing system of FIG. 3 with a printhead opposite a capping station according to one exemplary embodiment.

Track 282 comprises one or more structures configured to support webs 138 and 140 in an arc opposite to printheads 118 (shown in FIG. 3) during servicing of printheads 118. In the particular example shown, track 282 is further configured to guide unwinding of windings 254 and 260 from chamber 286 to chamber 288. In the particular example shown, track 282 includes a lower portion 316 and an opposite upper portion 318. Lower portion 316 is configured to extend generally beneath webs 138 and 140 to supports webs 138 and 140. As shown by FIG. 17, lower portion 316 includes an elongate circumferential opening 320 configured to allow interaction between lifters 224 (shown in FIG. 4) and web 140. As shown by FIGS. 6 and 17, upper portion 318 extends generally opposite to lower portion 316. Upper portion 318 has a side edge 322 extending just beyond web 138 to substantially expose web 138. Upper portion 318 extends opposite to lower portion 316 and forms a window 324 generally opposite to window 320, allowing lifters 224 (shown in FIG. 4) to engage and lift web 140 through window 324 into contact with printheads 118 during servicing. Lower portion 316 and upper portion 318 cooperate to guide and retain webs 138 and 140. Track 282 generally extends in an arc so as to support webs 138 and 140 in an arc. In the particular example shown, track 282 extends in an arc and supports webs 138 and 140 in an arc substantially the same as the arc in which the lower surfaces of printheads 118 are supported.

Drum datums 283 comprise surfaces configured to interact with corresponding surfaces associated with drum 112 so as to properly position cartridge 205 with respect to drum 112. In the particular example shown, drum datums 283 are spaced apart from one another and comprise blind holes configured to receive corresponding projections or pins (not shown) projecting from a drum supporting structure 356 (shown in FIG. 10). The projections or pins abut the floor of such blind holes to properly position cartridge body 250 and cartridge 205 with respect to one another. In other embodiments, datums 283 may have other configurations and may be provided at other locations of body 250.

Handle 284 generally comprises a structure configured to facilitate an operator obtaining a hold upon cartridge 205 to insert or remove cartridge 205 from guide 204 (shown in FIG. 4). In the particular example shown, handle 284 comprises a U-shaped structure affixed to housing 280.

Spool 252 generally comprises a member having a cylindrical surface about which winding 254 is wrapped. Spool 252 is rotatably supported within spool chamber 286. Spool 256 comprises a member having a cylindrical surface about which winding 260 is wound. Spool 256 is connected to spool 252 so as to be rotatably supported for rotation about the same axis as spool 252.

Divider 258 comprises a generally circular panel, sheet or the like supported between spools 252, 256 and windings 254, 260. Divider 258 separates windings 254 and 260. In one particular embodiment, divider 258 provides a lower friction face, facilitating unwinding of windings 254 and 260. In other embodiments, divider 258 may have other configurations or may be omitted.

Divider 262 is substantially identical to divider 258 except that divider 262 is located on an opposite side of winding 260 as divider 258. In one embodiment, divider 262 provides a low friction interface to facilitate unwinding or rotation of winding 260 relative to cover 264. In other embodiments, divider 262 may be omitted.

Cover 264 generally comprises a rigid plate configured to be releasably mounted to housing 250 so as to contain windings 254 and 260 within spool chamber 286 and about spools 252 and 256. In the particular example shown, cover 262 comprises a generally circular panel having three openings 328 by which cover 264 may be fastened by fasteners (not shown) to body 250. In other embodiments, cover 264 may be configured to be releasably coupled to body 250 opposite to spool chamber 286 by other securement methods.

Torque interface 266 comprises a member configured to interact with transmission 230 of torque source 212 so as to transmit torque to spools 268 and 272. In the particular example shown, torque interface 266 comprises a gear configured to be placed in meshing engagement with a gear of transmission 230 (shown in FIG. 4) when cartridge 205 is properly engaged with chassis 202 by retraction system 216 and latching system 218 (shown in FIG. 4). In other embodiments, torque interface 266 may comprise other structures configured to operably engage transmission 230 to transmit torque to spools 268 and 272.

Spools 268 and 272 serve as take up spools, taking up web 138 and web 140 of windings 254 and 260 that have been used. Spool 268 is generally fixed to torque interface 266 so as to be rotatably driven by torque transmitted to torque interface 266 from torque source 212. Spool 268 provides a cylindrical surface about which utilized portion of winding 254 may be wound. Likewise, spool 272 provides a cylindrical surface about which used portions of winding 260 may be wound. Spool 272 is operably coupled to spool 268 so as to rotate with spool 268.

Divider 270 generally comprises a panel or sheet extending between spools 268 and 272. Divider 270 is configured to separate used portions of winding 254 wrapped about spool 268 from used portions of winding 260 wrapped about spool 272. Divider 270 prevents used portions of winding 254 and 260 from interacting with one another. Although divider 270 is illustrated as being a generally circular panel or sheet, divider 270 may alternatively have other shapes or may be omitted.

Divider 274 is substantially identical to divider 270 and is coupled to spool 272 on an opposite side of spool 272 as divider 270. Divider 274 separates the used portions of winding 260 wrapped about spool 272 from cover 276. Although divider 274 is illustrated as being generally circular in shape, divider 274 may have other shapes or may be omitted.

Cover 276 generally comprises a panel configured to be releasably fixed to body 250 to secure and capture spools 268 and 272 and the used portions of windings 254 and 260 within chamber 288. In the particular example shown, door 276 includes three openings 332 for facilitating securement of door 276 to body 250 by fasteners (not shown). In other embodiments, cover 276 may be releasably secured to body 250 by other securement methods.

Overall, cartridge 205 enables windings 254, 260 of web material to be supported in an arc to facilitate interaction of webs 138 and 140 with printheads 118. At the same time, cartridge 205 may be quickly removed for replacement or repair. Cartridge 205 may also be reused by refurbishing spool chambers 286 and 288 with new windings 254 and 260. In particular, after removal of cartridge 205, doors 264 and 276 may be separated from body 250, allowing windings 254 and 260 to be removed and replaced by fresh windings 254 and 260. In particular embodiments, spools 252, 256, 268 and 272 and intermediate dividers 258, 270 may also be removed with the removal of used windings 254 and 260.

Cartridge lock 278 comprises a mechanism received within lock chamber 290 of housing 250 configured to facilitate locking and retention of cartridge 205 to chassis 202 as well as cartridge 205 (and chassis 202) axially relative to drum 112. In the particular example shown, cartridge lock 278 further facilitates clamping of cartridge 205 relative to chassis 202 as well as cartridge 205 (and chassis 202) axially relative to drum 112. In other embodiments, cartridge lock 278 may perform only one of the noted functions or may be omitted.

Figure 10:
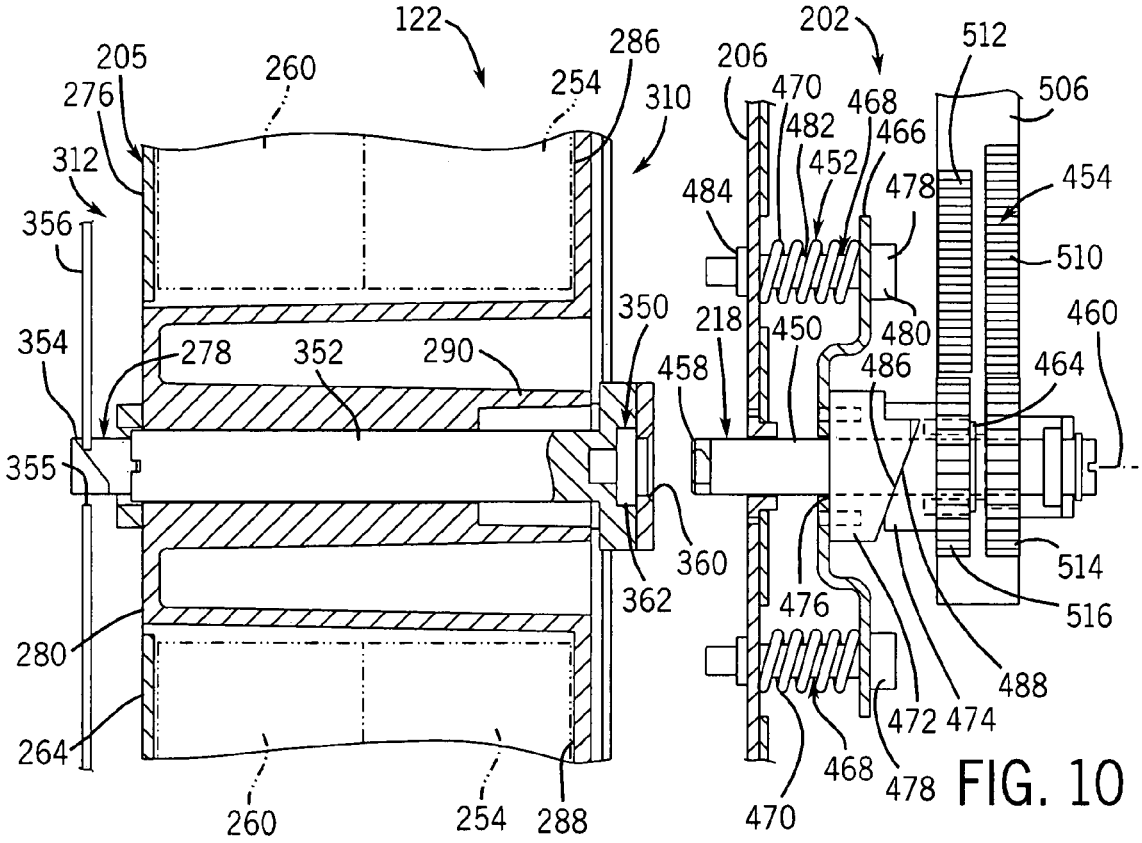
FIG. 10 is a sectional view schematically illustrating the cartridge proximate a chassis of the printing system of FIG. 3 according to one exemplary embodiment.
Figure 11:
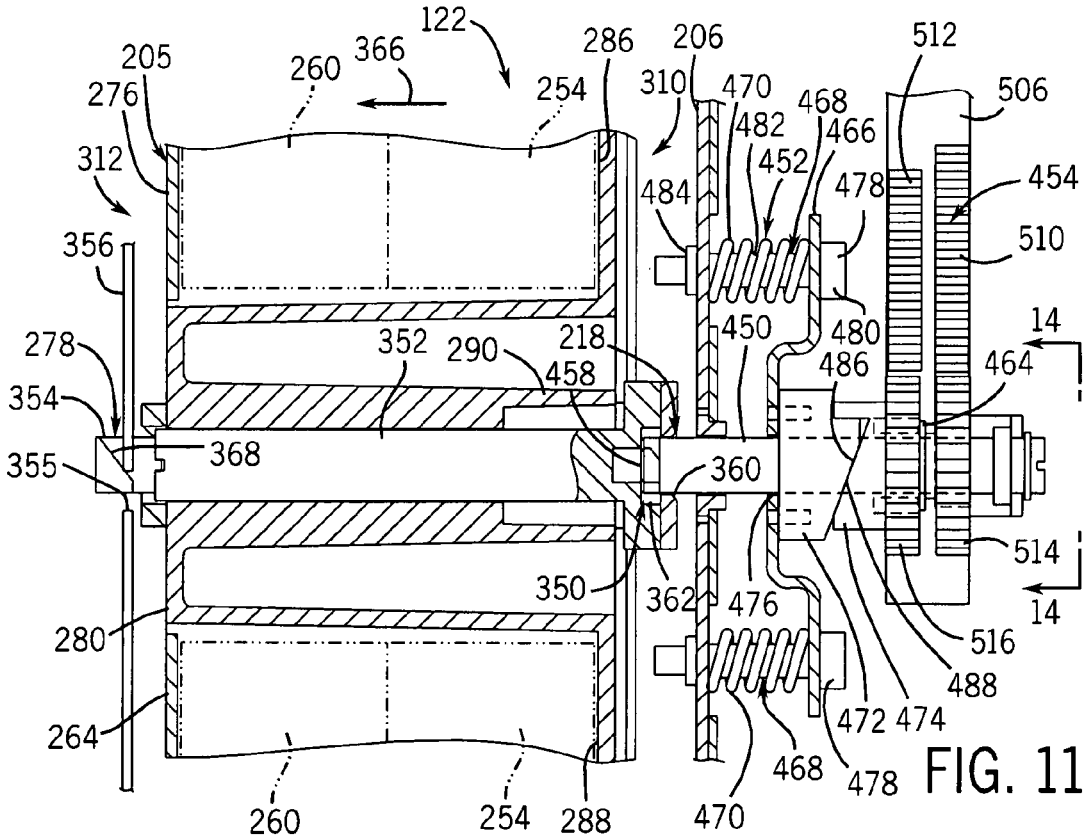
FIG. 11 illustrates the chassis actuated towards the cartridge of the printing system of FIG. 10 according to one exemplary embodiment.
Figure 12:
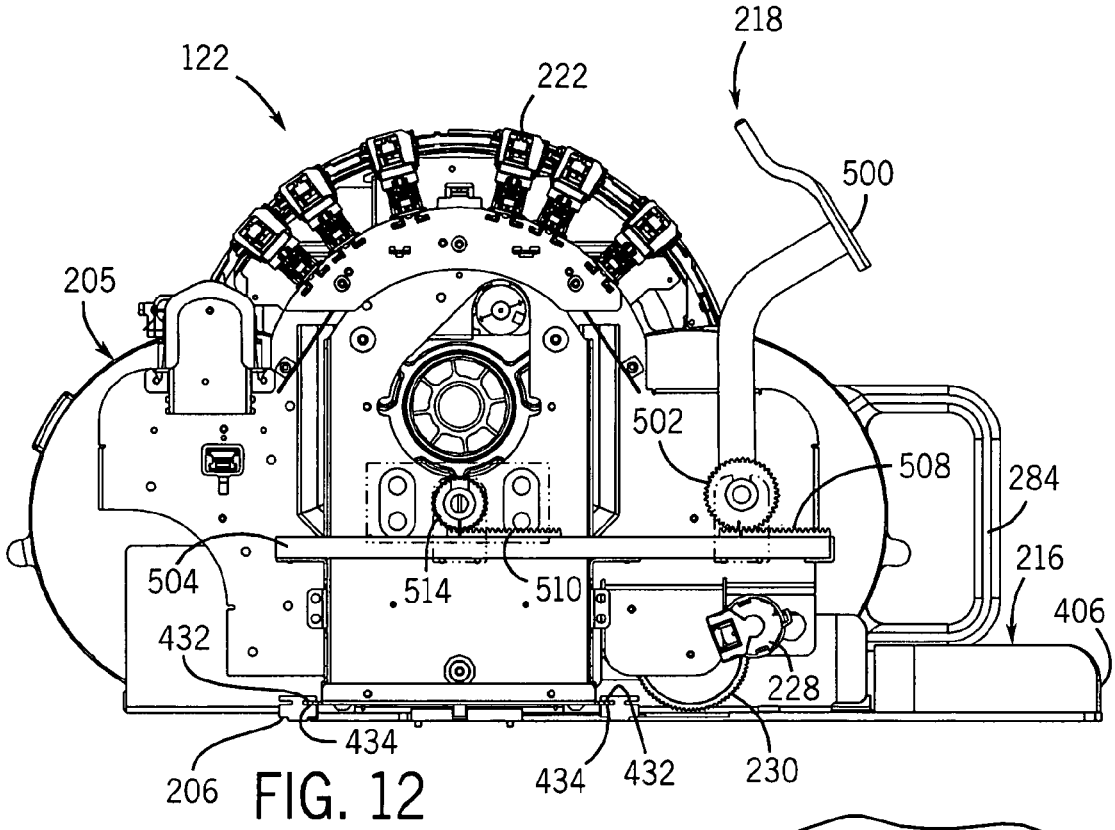
FIG. 12 is a side elevation view of the printing system of FIG. 7 according to one exemplary embodiment.
Figure 14:
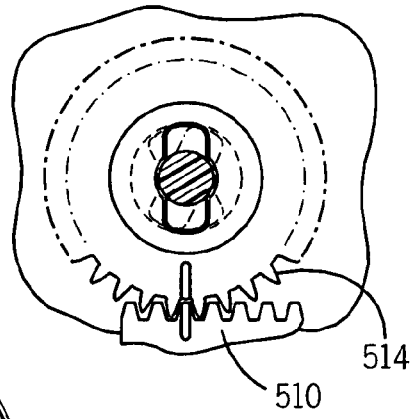
FIG. 14 is an enlarged fragmentary view of the printing system of FIG. 11 taken along line 14-14 of FIG. 11 illustrating insertion and rotation of a key into a key way according to one exemplary embodiment.
Figure 13:
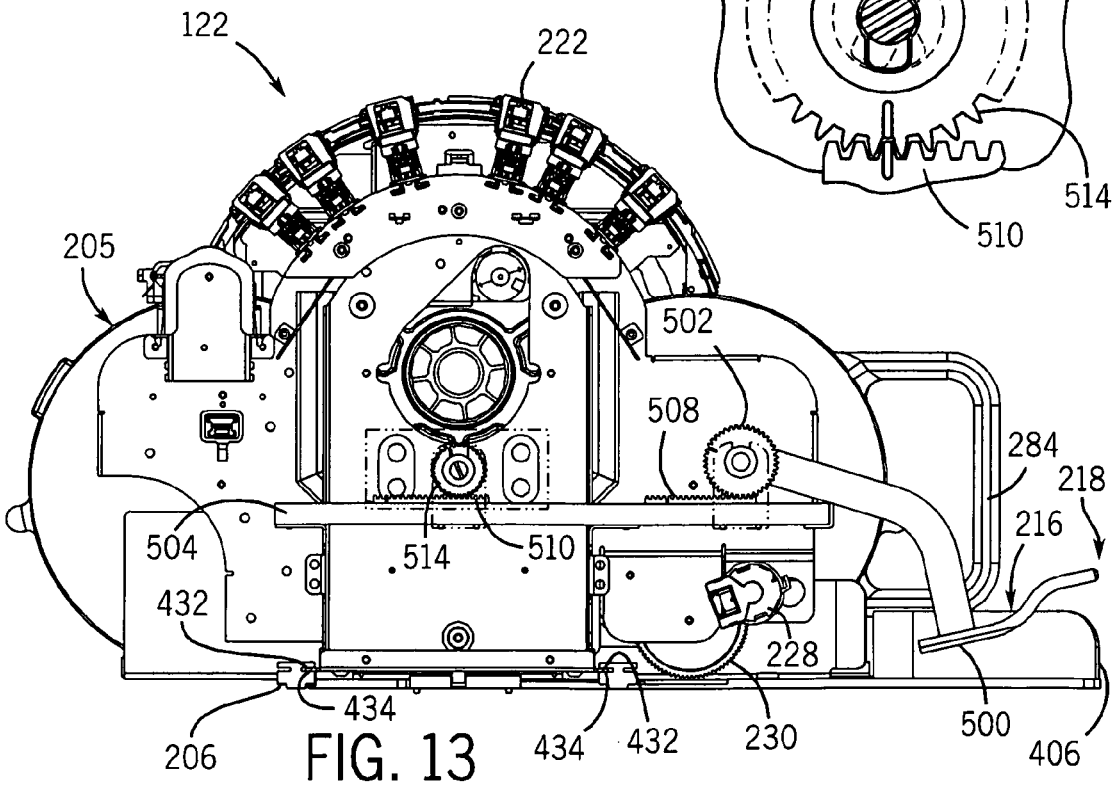
FIG. 13 illustrates a printing system of FIG. 12 upon actuation of a latching mechanism according to one exemplary embodiment.

In the particular example shown, cartridge lock 278 interacts with latching system 218. As shown by FIG. 10, cartridge lock 278 generally includes key way 350, shaft 352, cam 354 and cam 356. Key way 350 comprises an opening configured to receive and interact with latching system 218. In particular, key way 350 comprises an opening configured to receive a portion of latching system 218 such that latching system 218, upon being rotated, is axially captured within key way 350 to lock latching system 218 and a remainder of chassis 202 to cartridge 205. Key way 350 is further configured such that upon continued rotation of the inserted portion of latching system 218, shaft 352 is rotated within lock chamber 290. As shown by FIG. 14, key way 350 includes opening 360 and cavity 362. Opening 360 extends through a plate or other structure coupled or integrally formed as part of shaft 352 and communicates with cavity 362. Cavity 362 comprises an opening within shaft 352 having a first portion aligned with opening 360 and a second portion misaligned with opening 360. In use, a portion of latching system 218 is inserted through opening 360 into cavity 362 and is rotated so as to be axially captured within cavity 362.

Shaft 352 extends through lock chamber 290 to drum side 312 of cartridge 205. Shaft 352 is coupled to cam 354. During actuation of retraction system 216 (shown and described with respect to FIGS. 7-9), cam 354 is moved through an opening 355 of drum support 356. Drum support 356 comprises a panel or other structure axially secured relative to drum 112. Cam 354 interacts with drum support 356 such that rotation of shaft 352 and cam 354 pulls or urges shaft 352 in the direction indicated by arrow 366 shown in FIG. 11. As a result, in the example shown, datum pins or projections (not shown) extending from drum support 56 are urged into and against datums 283 of cartridge 205 (shown in FIG. 6) to properly position cartridge 205 and chassis 202 axially with respect to drum 112 (shown in FIG. 3). In the particular example illustrated, cam 354 comprises a helical cam including ramp surface 368 which bears against support 356 when rotated. In other embodiments, cam 354 may have other configurations such that rotation of shaft 352 pulls shaft 352 and the captured portion of latch mechanism 218 in the direction indicated by arrow 366.

Figure 7:
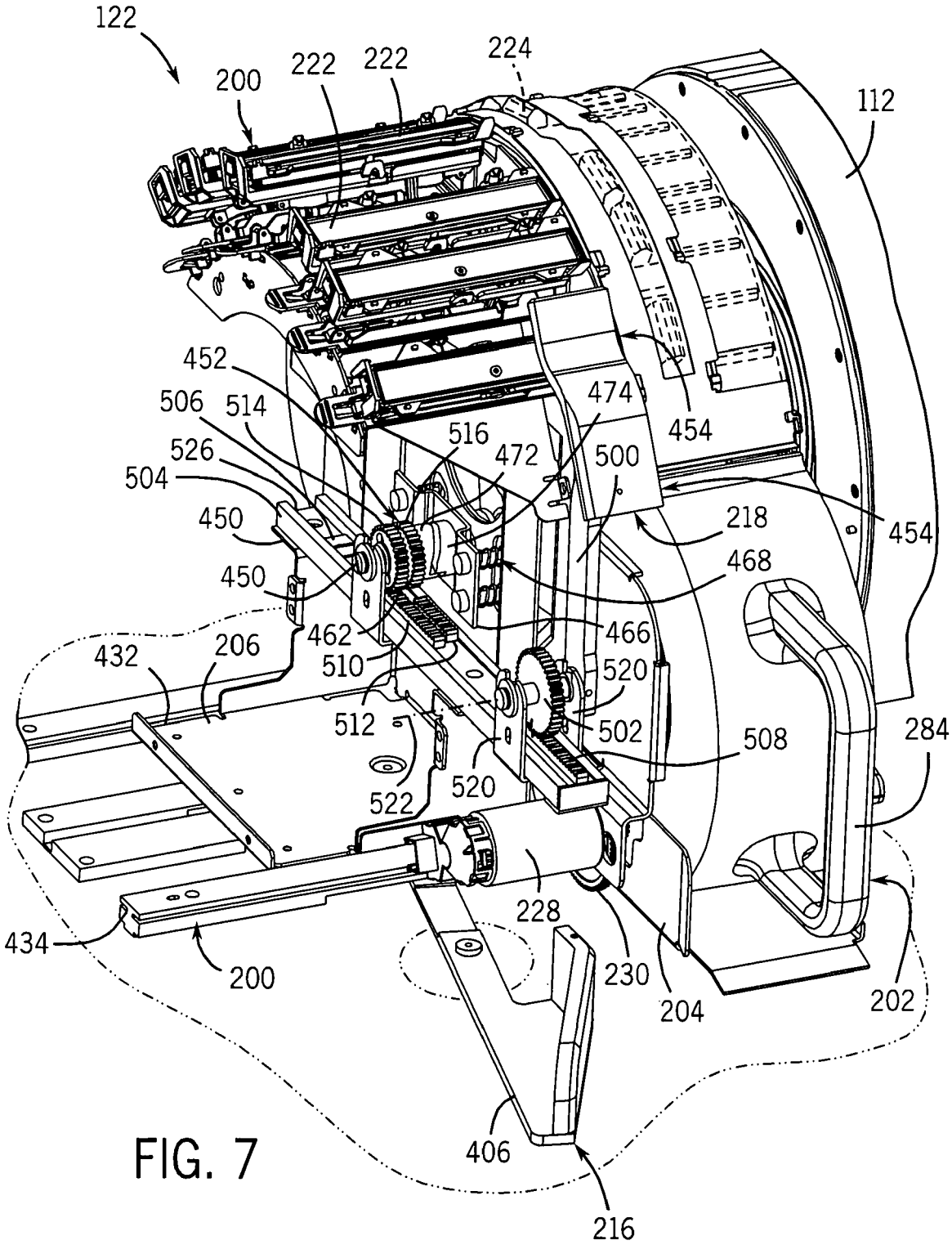
FIG. 7 is a fragmentary top perspective view of the printing system of FIG. 3 of which portions are not shown for purposes of illustration according to one exemplary embodiment.
Figure 8:
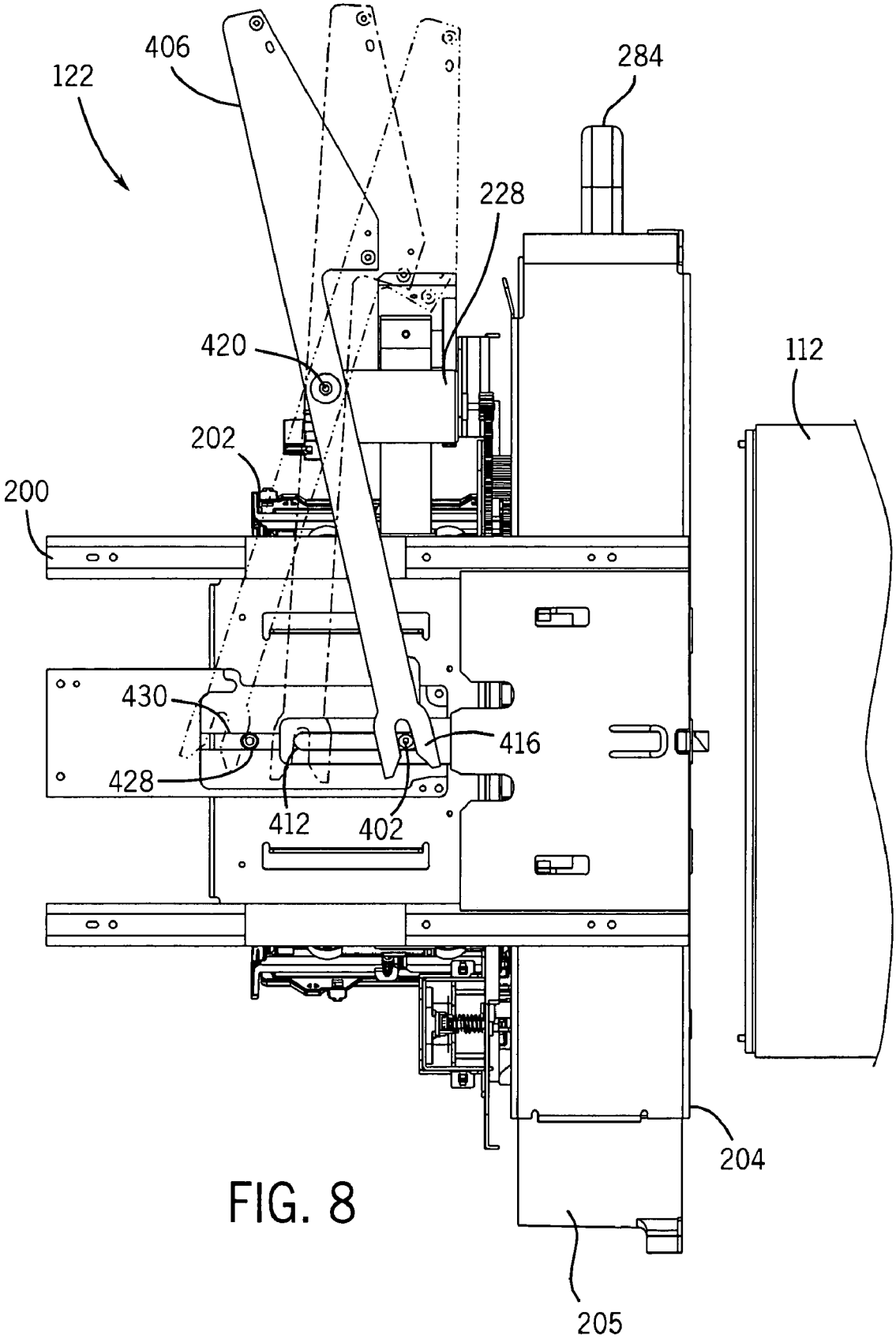
FIG. 8 is a bottom plan view of the printing system of FIG. 7 according to one exemplary embodiment.

FIGS. 7-16 illustrate retraction system 216, latching system 218 and their operation in detail. As shown by FIGS. 7, 8, 9 and 9A-9C, retraction system 216 generally includes projection 402, guide extension 404 and lever arm 406. Projection 402 is coupled to frame 206 which slidably supports chassis 202 and rests upon base 200 as seen in FIGS. 9A-9C. Guide extension 404 extends from guide 204 and includes an opening 408 through which projection 402 extends. Opening 408 is bordered by end surfaces 410 and 412. Lever arm 406 comprises an elongate lever pivotally coupled to base 200 and including a fork end 416 slidably receiving projection 402. As shown by FIGS. 8 and 9A-9C, lever arm 406 is pivotable about axis 420 (shown in FIG. 8) which linearly moves projection 402 within opening 408. As shown in FIGS. 9A and 9B, initial pivoting of lever arm 406 about axis 420 results in end 416 of lever arm 406 linearly moving projection 402 within opening 408 to move frame 206 in the direction indicated by arrow 422 away from guide 204 and away from drum 112. As shown by FIGS. 7 and 8, movement of frame 206 relative to base 200 is additionally guided by pin 428 coupled to and extending from frame 206 and sliding within and along channel 430 formed in base 200. As shown by FIG. 7, frame 206 is additionally guided by outwardly extending tabs 432 slidably received within elongate grooves 434 of base 200. In other embodiments, frame 206 may be slidably guided with respect to base 200 by other mechanisms.

Figure 9:
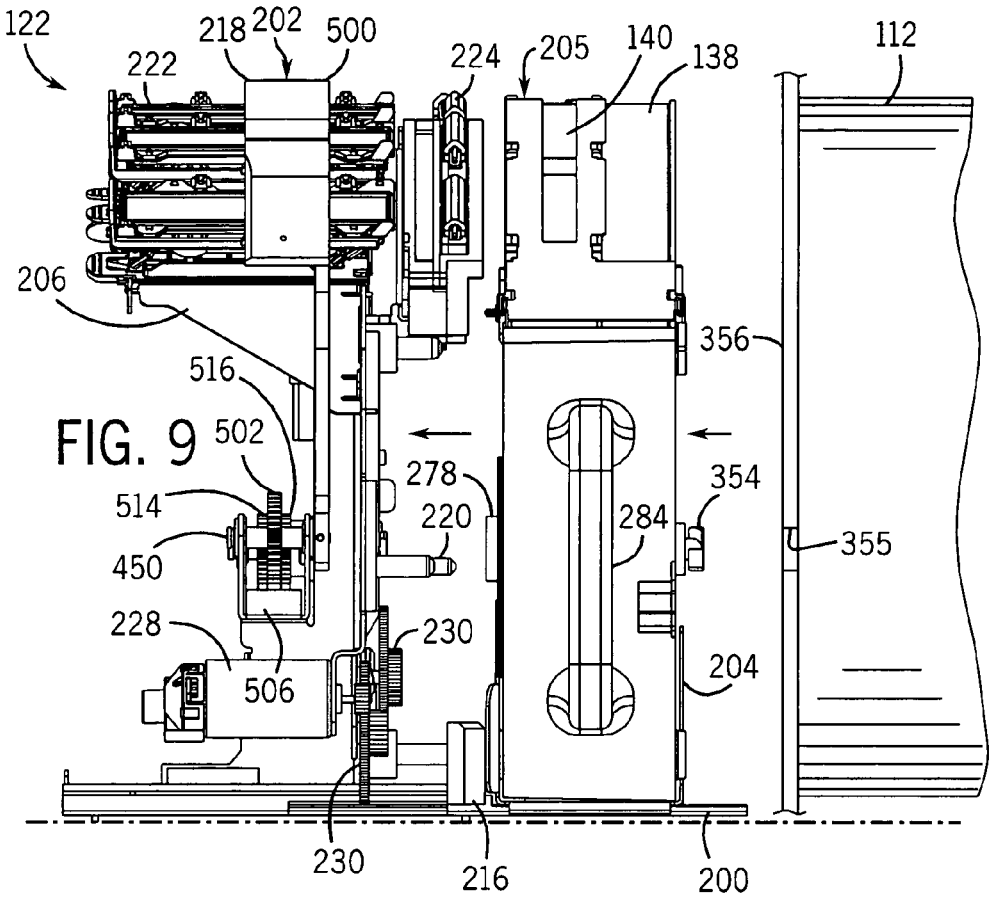
FIG. 9 is a side elevation view of the printing system of FIG. 7 illustrating separation of the cartridge and the chassis away from a drum of the printing system according to one exemplary embodiment.
Figure 9A:
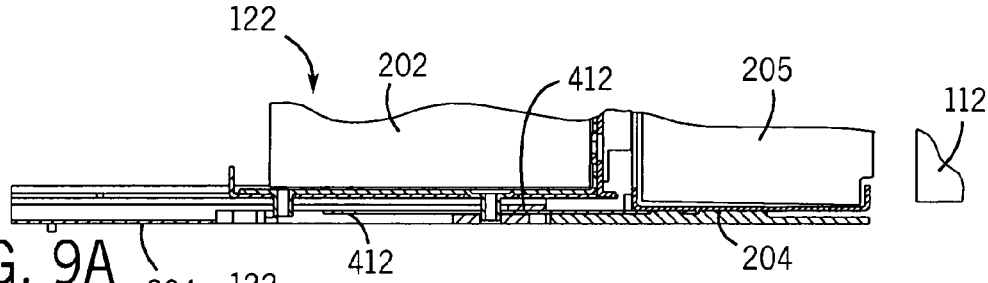
FIG. 9A is a fragmentary sectional view of the cartridge and the chassis in close proximity to the drum of the printing system of FIG. 9 according to one exemplary embodiment.
Figure 9B:
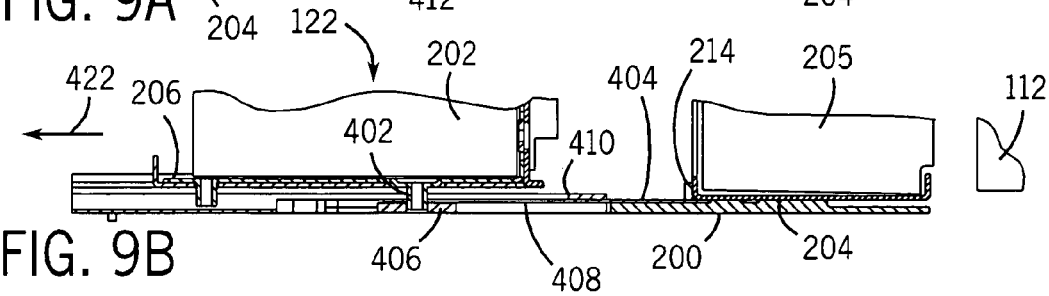
FIG. 9B illustrates the printing system of FIG. 9A upon separation of the chassis from the cartridge according to one exemplary embodiment.
Figure 9C:
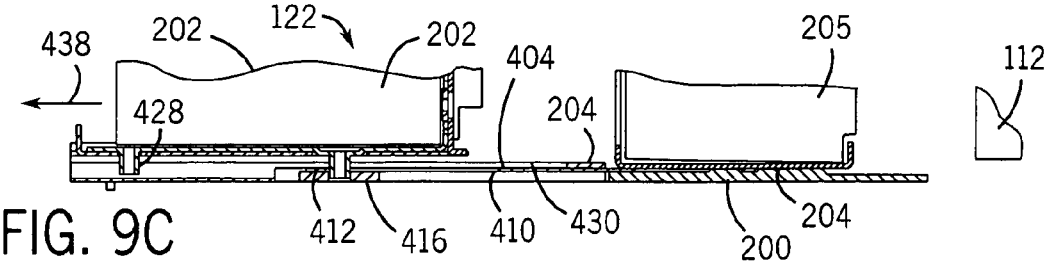
FIG. 9C illustrates the printing system of FIG. 9B with the chassis and the cartridge separated from the drum according to one exemplary embodiment.

As shown by FIG. 9C, continued pivoting of lever arm 406 about axis 420 (shown in FIG. 8) results in end 416 linearly moving projection 402 in the direction indicated by arrow 438 within window 408 until projection 402 engages end 412 to further move guide extension 404 and attached guide 204, with further movement of frame 206, away from drum 112 to the position shown in FIGS. 4 and 9. At this point, cartridge 205 may be removed from guide 204 and its covers 264 and 276 (shown in FIG. 6) may be removed as shown in FIG. 4 for replacement of one or both of windings 254 and 260 (shown in FIG. 6) or for complete replacement or repair of entire cartridge 205.

To insert a new, repaired or refurbished cartridge, chassis 202 is actuated to the configuration shown in FIG. 4, the same configuration from which previous cartridge 205 was withdrawn. The new, refurbished or repaired cartridge 205 is then slid into guide 204 until a lower end of cartridge body 250 engages an appropriate stop surface projecting from floor 234 or sides 236 of guide 204. Once cartridge 205 is properly positioned within guide 204 and aligned with spindles 220 of chassis 202, lever arm 406 is pivoted about axis 420 (as shown in FIG. 8) to move guide 204 and frame 206 carrying the remaining components of chassis 202 relative to foundation 200 and into close proximity with one another. In particular, lever arm 406 is pivoted about axis 420 in an opposite direction to reverse the sequence previously illustrated and described with respect to FIGS. 9A-9C.

FIGS. 7 and 10 illustrate latching system 218 in detail. As noted above, latching system 218 is configured to lock and clamp chassis 202 relative to cartridge 205 and axially relative to drum 112. Latching system 218 generally includes key 450, clamp mechanism 452 and actuation mechanism 454. Key 450 is configured to be releasably locked to cartridge lock 278 and to rotate cartridge lock 278 to urge or clamp cartridge 205 and chassis 202 towards one another. As shown by FIG. 10, key 450 generally comprises a shaft having an eccentrically shaped end 458 (also shown in FIG. 14) configured to be inserted through opening 360 into cavity 362 of key way 350 of cartridge lock 278 and to be rotated about axis 460 by actuation mechanism 454 to move end 458 within cavity 362 to axially capture end 458 within key way 350. Although end 458 is illustrated as generally a bar perpendicular to axis 460, eccentric end 458 may have other shapes and configurations depending upon the shape and configuration of key way 350 of cartridge lock 278.

Key 450 is rotatably supported for rotation about axis 460 by trunion 462 of frame 206. Key 450 is further configured for slidable movement along axis 460 in response to actuation of clamping mechanism 452. In the example shown, key 450 additionally includes shoulder 464 which facilitates axial movement of key 450 along axis 460 by clamp mechanism 452.

Clamping mechanism 452 is configured to further clamp or urge cartridge 205 and chassis 202 towards one another. Clamping mechanism 452 generally includes sliding member 466, bolt assemblies 468, springs 470 and helical cams 472, 474. Sliding member 466 comprises a structure, such as a plate, having an aperture 476 through which key 450 extends, enabling member 466 to slide along axis 460. Bolt assemblies 468 couple member 466 to frame 206. Bolt assemblies 468 are configured to facilitate axial movement of member 466 along axis 460 relative to frame 206 while retaining springs 470 in place between frame 206 and member 466.

Bolt assemblies 468 each generally include a bolt 478 having a head 480 and a shaft 482, threaded feature 484 such as a PEM nut. Each shaft 482 is passed through an opening in member 466 and through and threadably engaging a threaded feature 484 (e.g., a PEM nut) of frame 206 with head 480 abutting member 466 and the threaded feature 484 fastened to shaft 482 on an opposite side of frame 206. Each shaft 482 retains spring 470 between frame 206 and member 466. Springs 470 comprise compression springs which urge member 466 away from frame 206.

Although clamping mechanism 452 is illustrated as including bolt assemblies 468, other mechanisms may be used to movably secure member 466 relative to frame 206 and to retain springs 470 between frame 206 and member 466. For example, in other embodiments, shaft 482 may alternatively be integrally formed as a single unitary body or permanently welded or otherwise bonded to member 466 with shaft 482 slidably passing through an aperture in frame 206. In other embodiments, shaft 482 may be integrally formed as part of a single unitary body or permanently bonded or fixed to frame 206 while slidably passing through member 466.

Cylindrical cam 472 comprises a structure having a ramp 486 configured to slide along axis 460 and along key 450 while being retained against rotation about axis 460. In the particular example shown, cam 472 is fastened to member 466 which facilitates movement of cam 472 along axis 460 and prevents rotation of cam 472 about axis 460. In other embodiments, cam 472 may be slidably supported along axis 460 and retained against rotation about axis 460 by other structures.

Cam 474 comprises a structure configured to rotate about axis 460 relative to and about key 450. Cam 474 is further configured to axially move along axis 460 and along key 450 until and in abutment with shoulder 464 of key 450. Cam 474 includes ramp 488 complementary to and opposite ramp 486 of cam 472 such that rotation of cam 474 about axis 460 causes ramp 488 to ride on ramp 486 to increase an axial distance between shoulder 464 and member 466.

Actuation mechanism 454 is configured to actuate key 450 and clamping mechanism 452. In particular, actuation mechanism 454 is configured to rotate key 450 about axis 460 to lock key 450 in key way 350 and to rotate cam 354 relative to cam 356 to initially clamp cartridge 205 and chassis 202 towards one another and against datums of drum support 356. Actuation mechanism 454 is further configured to rotate cam member 474 to further clamp chassis 202 and cartridge 205 towards one another. In the particular example shown, actuation mechanism 454 includes lever arm 500, pinion gear 502, guide 504, bar 506 including rack gears 508, 510 and 512, pinion gear 514 and pinion gear 516. Lever arm 500 comprises an elongate arm pivotally supported by trunions 520 of frame 206 for rotation about axis 522. Lever arm 500 is coupled to pinion gear 502 to rotate pinion gear about axis 522.

Guide 504 comprises an elongate structure configured to guide movement of bar 506 and its rack gears 508, 510 and 512 relative to and in meshing engagement with pinion gears 502, 514 and 516, respectively. In the particular example shown, guide 504 comprises an elongate member providing a channel 526 along which bar 506 slides.

Pinion gear 514 is in meshing engagement with rack gear 510 and is secured to key 450 such that movement of bar 506 and rack gear 510 rotates pinion gear 514 to rotate key 450. Pinion gear 516 is secured to cam member 474 and is configured to be engaged by rack gear 512 such that movement of bar 506 and rack gear 512 while in engagement with pinion 516 rotates cam 474 to actuate clamping mechanism 452.

Figure 15:
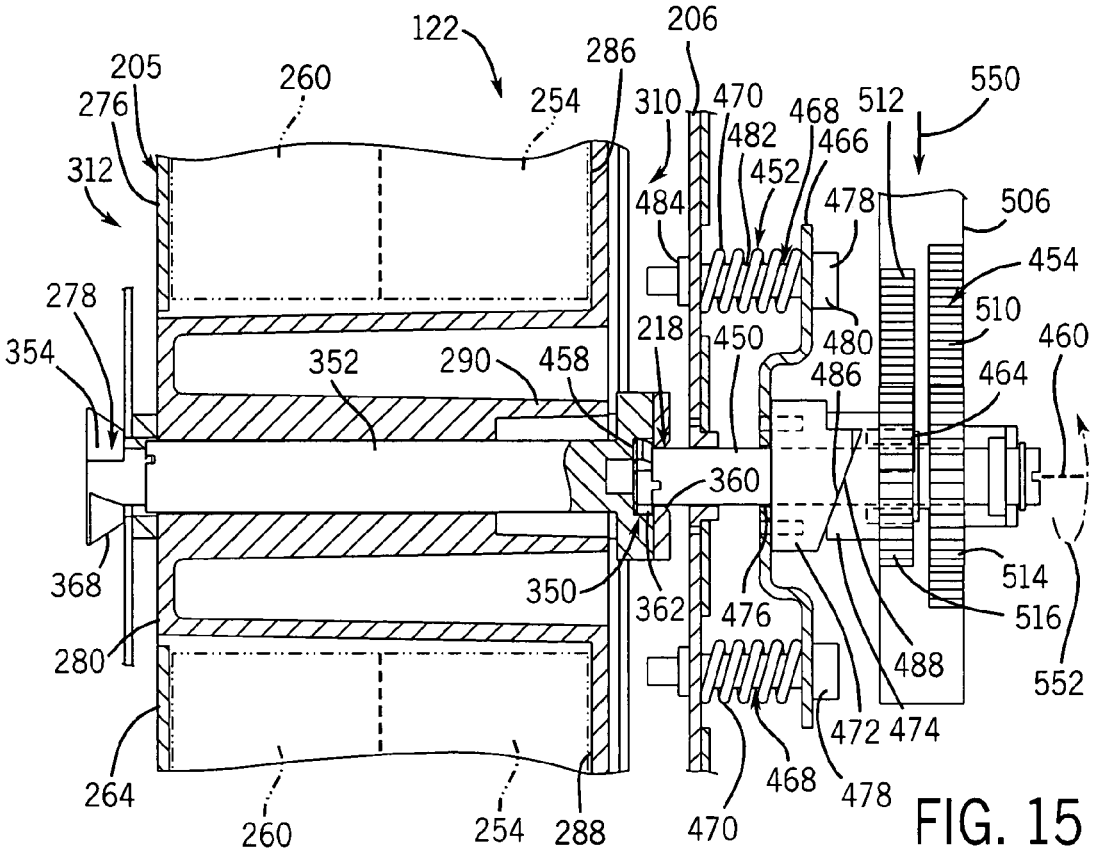
FIG. 15 illustrates the printing system of FIG. 11 upon actuation of a locking mechanism according to one exemplary embodiment.
Figure 16:
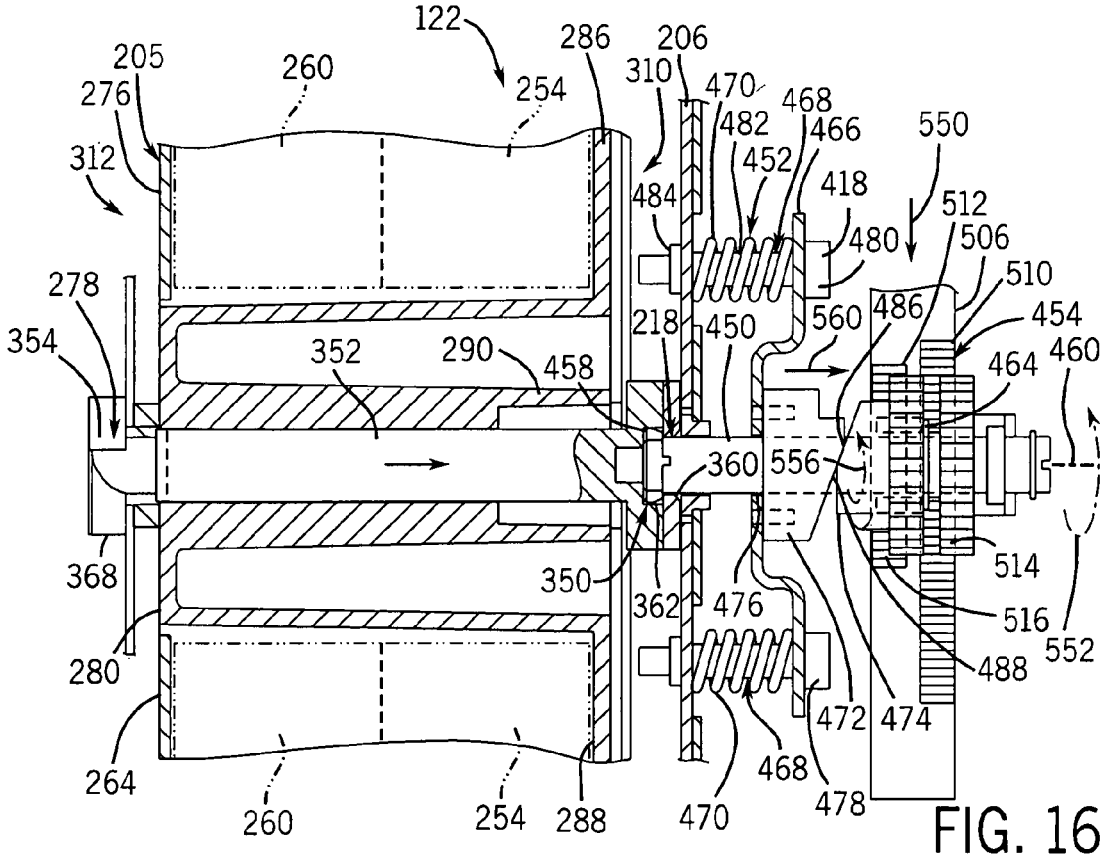
FIG. 16 illustrates the printer of FIG. 15 illustrating further actuation of a clamping mechanism according to one exemplary embodiment.

FIGS. 15 and 16 illustrate the overall operation of latching system 218. As shown by FIG. 15, after retraction system 216 has been actuated to move key 450 into key way 350 of cartridge 205, lever arm 500 is pivoted about axis 522 (shown in FIG. 7) to cause pinion gear 502 to engage rack gear 508 and to linearly move bar 506 in the direction indicated by arrow 550. As a result, rack gear 510 is moved into meshing gear with pinion gear 514 to rotate pinion gear 514 and key 450 in the direction indicated by arrow 552. Rotation of key 450 causes its end 458 to rotate within cavity 362 so as to be axially captured within cavity 362. Further rotation of key 450 about axis 460 rotates shaft 352 and cam 354 such that cam 354 acts upon cam 356 to initially urge cartridge 205 towards frame 206 of chassis 202 and to urge datum 283 (shown in FIG. 6) against datum (not shown) of drum support 356.

FIG. 16 illustrates further downward pivoting of lever arm 500 about axis 522 (shown in FIG. 7) such pinion gear 502 continues to engage rack gear 508 to linearly move bar 506 in the direction indicated by arrow 550 by a distance such that rack gear 512 engages pinion gear 516 to rotate pinion gear 516 and cam 474 in the direction indicated by arrow 556. As indicated by arrow 552, continued movement of bar 506 in the direction indicated by arrow 550 also continues to move rack gear 510 relative to pinion gear 514 to further rotate key 450, shaft 352 and cam 354 such that cam 354 further interacts with cam 356 to clamp cartridge 205 towards frame 206. As shown by FIG. 16, rotation of cam 474 causes ramp 488 to ride upon ramp 486 to spread apart cams 472 and 474 such that cam 474 applies an axial force against shoulder 464 of key 450 to additionally pull key 450 and shaft 352 along axis 460 in the direction indicated by arrow 560 to further clamp cartridge 205 towards frame 206 of chassis 202. The clamping of cartridge 205 towards frame 206 facilitates the positioning of cartridge 205 against predefined datum surfaces on drum support 356 to position torque interface 266 in meshing engagement with transmission 230 and to position web 140 over lifters 224 of wiper actuation system 210.

FIGS. 17-20 schematically illustrate one example scenario for servicing of printheads 118 by service station 122. FIG. 17 illustrates carriage 120 moved so as to position printhead 118 opposite to one of capping modules 222 which cap printhead 118.

Figure 18:
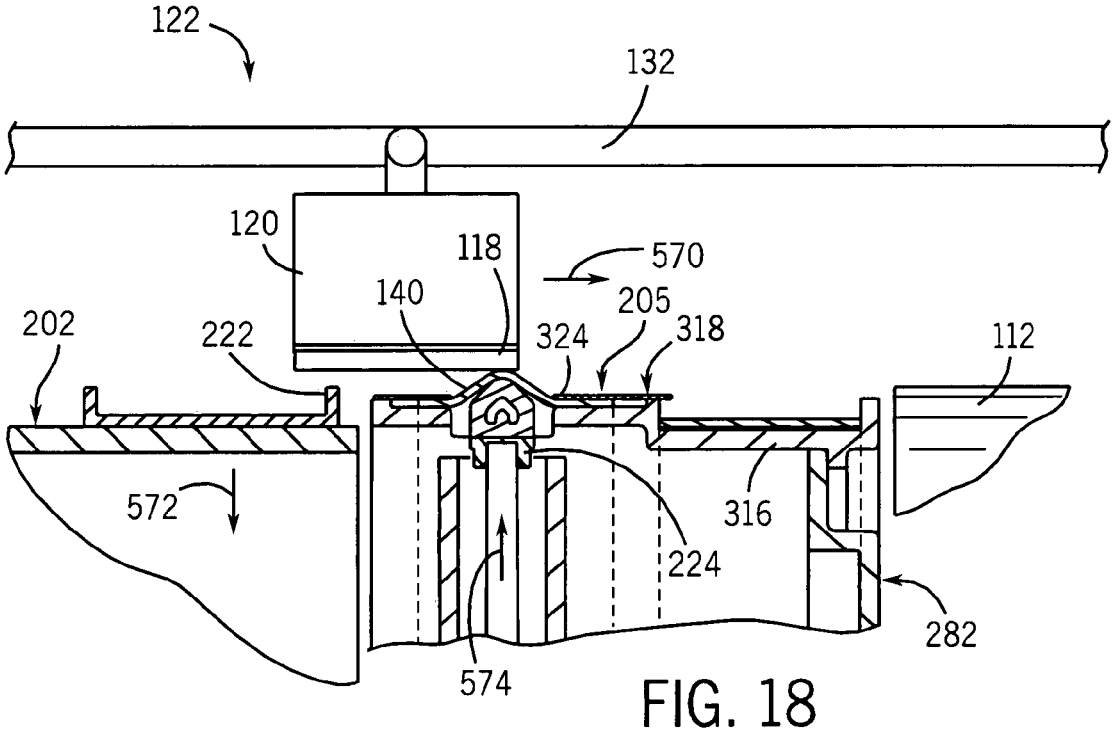
FIG. 18 is a fragmentary sectional view schematically illustrating the printing system of FIG. 3 with the printhead in a wiping position according to one exemplary embodiment.

FIG. 18 illustrates further movement of carriage 120 along rail 132 in the direction indicated by arrow 570 to position printhead 118 opposite to window 324 and web 140. As indicated by arrow 572, capper 222 is withdrawn. As indicated by arrow 574, lifter 224 is extended to lift web 140 into contact with printhead 118 for wiping printhead 118.

Figure 19:
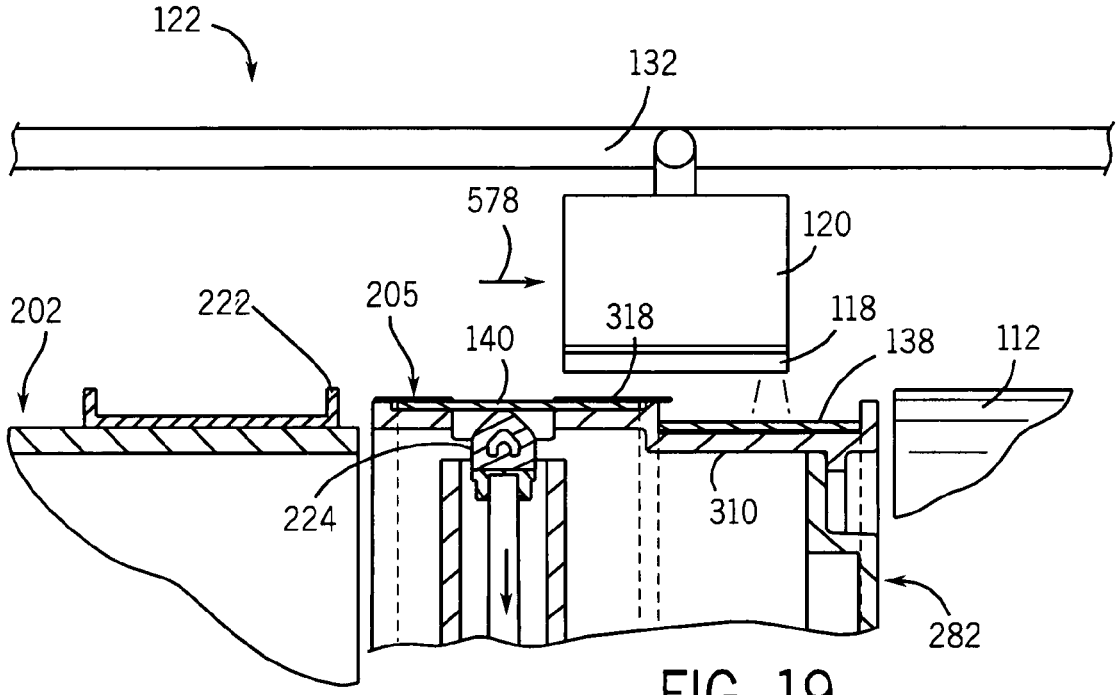
FIG. 19 is a fragmentary sectional view schematically illustrating the printing system of FIG. 3 with the printhead in a fluid discharging position according to one exemplary embodiment.

FIG. 19 illustrates the further movement of carriage 120 along rail 132 in the direction indicated by arrow 578 to position printhead 118 opposite to web 138. Once positioned opposite to web 138, printheads 118 may be actuated to discharge or spit fluid, such as ink, onto web 138 so as to clear nozzles of printhead 118. Web 138 absorbs discharged fluid from nozzles of printhead 118. Upon completion of the discharge of fluid from printhead 118, motor 228 may rotatably drive spools 268 and 272 (shown in FIG. 6) to position clean or unused webs 138 and 140 across track 282 as needed.

Figure 20:
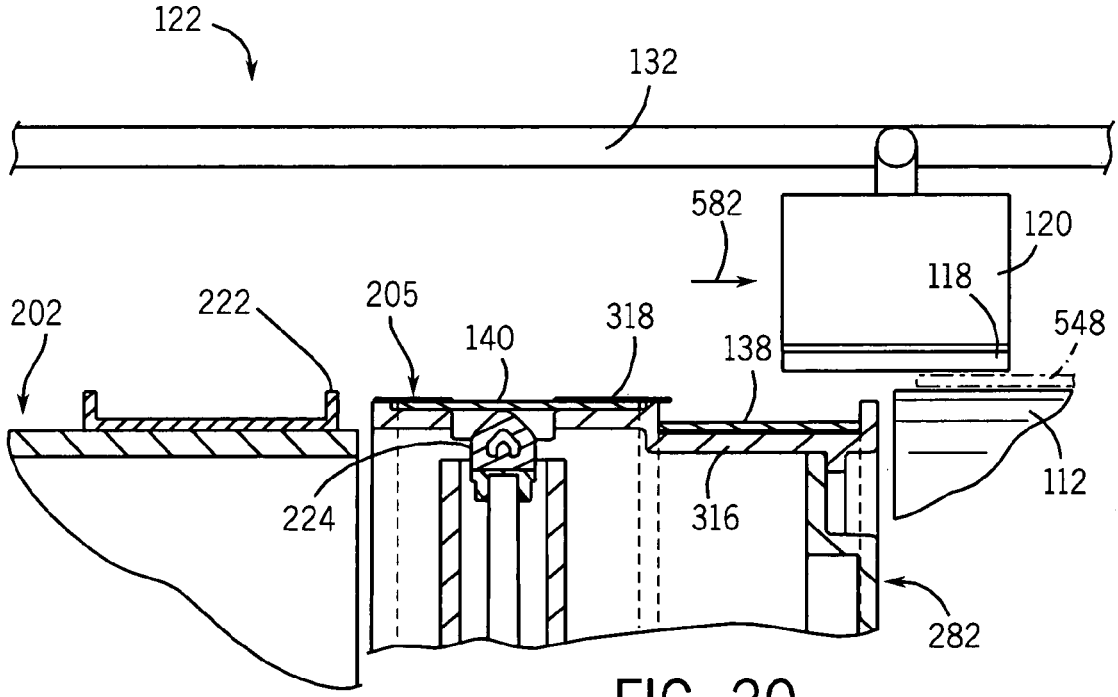
FIG. 20 is a fragmentary sectional view schematically illustrating the printhead in a fluid printing position.

FIG. 20 illustrates further movement of carriage 120 along rail 132 in the direction indicated by arrow 582 to position printhead 118 opposite to media 584 supported by drum 112. Thereafter, fluid, such as ink, may be printed or otherwise deposited upon media 548.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a drum along an axis;

printheads arcuately arranged about the axis;

a media supply configured to supply an individual sheet to the drum;

a media output configured to withdraw the individual sheet from the drum; and a first web extending in an arc about the axis;

an arcuate track spaced from the drum and configured to guide movement of the first web about the axis;

a first spool and a second spool, wherein the first web wraps about the first spool and the second spool;

a housing joining the first spool, the second spool and the track a torque source, wherein the second spool is removably coupled to the torque source; and a guide configured to receive the housing, wherein the guide moves between a first position in which the second spool is coupled to the torque source and a second position in which the second spool is disengaged from the torque source.

2. The apparatus of claim 1 further comprising:

a second web of material extending in an arc about the axis, wherein the second web wraps about the first spool.

3. The apparatus of claim 2 further comprising a lifter movable between a wiping position in which the lifter positions the first web in contact with at least one of the printheads and a retracted position in which the first web is out of contact with the at least one of the printheads.

4. The apparatus of claim 1 including at least one support surface opposite the first web and configured to radially move the first web with respect to the axis away from the axis into physical contact with at least one of the printheads.

5. The apparatus of claim 4, wherein the at least one support surface includes support surfaces arcuately spaced about the axis.

6. The apparatus of claim 1, wherein the guide is configured to receive the housing in a direction substantially perpendicular to the axis.

7. The apparatus of claim 6, wherein the guide moves along the axis between the first position and the second position.

8. The apparatus of claim 7 further comprising a lever operably coupled to the guide to move the guide between the first position and the second position.

9. The apparatus of claim 1 further comprising:

a chassis including a torque source, wherein the chassis is movable relative to the guide.

10. The apparatus of claim 1 further comprising:

a chassis movable relative to the guide; and at least one clamping mechanism configured to urge the chassis and the housing together.

11. The apparatus of claim 1 further comprising a cartridge body comprising:

a first chamber having a first cover configured to permit insertion and withdrawal of the first spool; and a second chamber having a second cover configured to permit insertion and withdrawal of the second spool.

12. The apparatus of claim 1 further comprising a cartridge body comprising:

at least one chamber containing the first spool and the second spool, wherein the first web extends between the first spool and the second spool and wraps about the first spool and the second spool; and a window through the body and opposite at least one of the first spool and the second spool.

13. The apparatus of claim 1, wherein the track is configured to extend on opposite faces of the first web.

14. The apparatus of claim 1 further comprising:

a cartridge comprising the housing, the first spool, the second spool, the track and the guide, wherein the cartridge is configured to be completely withdrawn and separated from the guide and the drum without use of tools.

15. The apparatus of claim 14, wherein the guide is configured to receive the housing in a direction substantially perpendicular to the axis.

16. The apparatus of claim 14 further comprising a chassis including a torque source, wherein the chassis is movable relative to the guide.

17. The apparatus of claim 14 further comprising:

a chassis movable relative to the guide; and at least one clamping mechanism configured to urge the chassis and the housing together.

18. The apparatus of claim 1 further comprising:

a cartridge comprising the housing, the first spool, the second spool and the track, wherein the cartridge further comprises a chassis including a first spindle rotationally guiding the first spool and a second spindle rotationally guiding the second spool, wherein the cartridge is removable from the chassis to withdraw the first spindle from the first spool and the second spindle from the second spool.

19. The apparatus of claim 18, wherein the cartridge is configured to be completely withdrawn and separated from the guide and the drum without the use of tools.

20. The apparatus of claim 1 further comprising:

a second web of material extending in an arc about the axis, wherein the second web wraps about the first spool, wherein the track supports the first web at a first radial distance from the axis and the second web at a second distinct radial distance from the axis.

21. The apparatus of claim 1 further comprising:

a second web of material extending in an arc about the axis, wherein the second web wraps about the first spool; and a third spool coaxial with the second spool, wherein the second web wraps about the third spool, wherein the arcuate track extends between the first spool and the second spool.

22. The apparatus of claim 21 further comprising a divider between the second spool and the third spool and configured to separate portions of the first web wrapped about the second spool from portions of the second web wrapped about the third spool.

23. The apparatus of claim 1 further comprising:

a chassis including a torque source; and a cartridge comprising:

the housing, the first spool, the second spool and the track; and a lock received within the housing and configured to facilitate locking and retention of the cartridge to the chassis and axially relative to the drum.

24. The apparatus of claim 1, wherein the first web extends along an axial end of the drum.

25. The apparatus of claim 1 further comprising:

a chassis including a torque source; and a cartridge comprising:

the housing, the first spool, the second spool and the track; and a U-shaped handle extending from the housing and configured to facilitate positioning of the cartridge with respect to the chassis.

26. The apparatus of claim 1 further comprising:

a cartridge comprising the housing, the first spool, the second spool and the track; and a chassis including a sensor configured to detect expended and remaining amounts of the first web.

27. An apparatus comprising:

a drum along an axis;

printheads about the axis;

a first web extending in an arc about the axis;

an arcuate track configured to guide movement of the first web about the axis;

a first spool and a second spool, wherein the first web wraps about the first spool and the second spool;

a housing joining the first spool, the second spool and the track;

a torque source, wherein the second spool is removably coupled to the torque source; and a guide configured to receive the housing, wherein the guide moves between a first position in which the second spool is coupled to the torque source and a second position in which the second spool is disengaged from the torque source.

28. The apparatus of claim 27, wherein the guide is configured to receive the housing in a direction substantially perpendicular to the axis.

29. The apparatus of claim 28, wherein the guide moves along the axis between the first position and the second position.

30. The apparatus of claim 29 further comprising a lever operably coupled to the guide to move the guide between the first position and the second position.

31. The apparatus of claim 27 further comprising:

a chassis including a torque source, wherein the chassis is movable relative to the guide.

32. The apparatus of claim 27 further comprising:

a chassis movable relative to the guide; and at least one clamping mechanism configured to urge the chassis and the housing together.

33. An apparatus comprising:

a drum along an axis;

printheads about the axis;

a first web extending in an arc about the axis;

a first spool and a second spool, wherein the first web wraps about the first spool and the second spool;

a second web of material extending in an arc about the axis, wherein the second web wraps about the first spool; and an arcuate track between the first spool and the second spool, wherein the track supports the first web at a first radial distance from the axis and the second web at a second distinct radial distance from the axis.

34. An apparatus comprising:

a drum along an axis;

printheads about the axis;

a first web extending in an arc about the axis;

a first spool and a second spool, wherein the first web wraps about the first spool and the second spool;

a second web of material extending in an arc about the axis, wherein the second web wraps about the first spool;

a third spool coaxial with the second spool, wherein the second web wraps about the third spool; and an arcuate track between the first spool and the second spool.

35. An apparatus comprising:

a drum along an axis;

printheads arcuately arranged about the axis;

a media supply configured to supply an individual sheet to the drum;

a media output configured to withdraw the individual sheet from the drum;

a first web extending in an arc about the axis;

a first spool and a second spool, wherein the first web wraps about the first spool and the second spool; and a second web of material extending in an arc about the axis, wherein the second web wraps about the first spool.

36. An apparatus comprising:

a drum along an axis;

printheads arcuately arranged about the axis;

a media supply configured to supply an individual sheet to the drum;

a media output configured to withdraw the individual sheet from the drum;

a first web extending in an arc about the axis;

a cartridge comprising:

a first spool and a second spool;

an arcuate track between the first spool and the second spool, wherein the first web wraps about the first spool and the second spool; and a housing joining the first spool, the second spool and the track; and a guide coupled to the drum and configured to removably receive and guide movement of the cartridge with respect to the drum, wherein the cartridge is configured to be completely withdrawn and separated from the guide and the drum without use of tools.

37. The apparatus of claim 36, wherein the guide is configured to receive the housing in a direction substantially perpendicular to the axis.

38. The apparatus of claim 36 further comprising a chassis including a torque source, wherein the chassis is movable relative to the guide.

39. The apparatus of claim 36 further comprising:

a chassis movable relative to the guide; and at least one clamping mechanism configured to urge the chassis and the housing together.

* * * * *